US012098445B2

(12) United States Patent
Zhu et al.

(10) Patent No.: US 12,098,445 B2
(45) Date of Patent: Sep. 24, 2024

(54) TITANIUM ALLOY PRODUCT, HOUSING, AND METHOD FOR MANUFACTURING THE SAME

(71) Applicant: SHENZHENSHI YUZHAN PRECISION TECHNOLOGY CO., LTD., Shenzhen (CN)

(72) Inventors: Wen-Cheng Zhu, Shenzhen (CN); Xiao-Qing Fu, Shenzhen (CN); Jing-Ping Sang, Shenzhen (CN); Li-Ming Shen, Shenzhen (CN); Qing Lin, Shenzhen (CN)

(73) Assignee: SHENZHENSHI YUZHAN PRECISION TECHNOLOGY CO., LTD., Shenzhen (CN)

( * ) Notice: Subject to any disclaimer, the term of this patent is extended or adjusted under 35 U.S.C. 154(b) by 36 days.

(21) Appl. No.: 17/699,502

(22) Filed: Mar. 21, 2022

(65) Prior Publication Data

US 2022/0298604 A1 Sep. 22, 2022

(30) Foreign Application Priority Data

Mar. 19, 2021 (CN) ..... 202110298354.9

(51) Int. Cl.
*C25D 11/08* (2006.01)
*C22C 14/00* (2006.01)
(Continued)

(52) U.S. Cl.
CPC ..... *C22C 14/00* (2013.01); *C23F 1/20* (2013.01); *C23F 17/00* (2013.01); *C25D 11/08* (2013.01); *C25D 11/10* (2013.01); *C25D 11/18* (2013.01); *C25D 11/24* (2013.01); *C25D 11/34* (2013.01); *C25F 3/08* (2013.01); *C25D 11/06* (2013.01)

(58) Field of Classification Search
CPC ..... C25F 3/08; C25D 11/34; C25D 11/026
See application file for complete search history.

(56) References Cited

U.S. PATENT DOCUMENTS 9,187,841 B2 * 11/2015 Lai ..... C25D 11/246
2015/0077902 A1 * 3/2015 Petrzilek ..... H01G 9/08 205/188
2020/0362466 A1 * 11/2020 Vidra ..... A61L 27/306

FOREIGN PATENT DOCUMENTS

CN 101233601 A 7/2008
CN 111188081 A 5/2020
(Continued)

OTHER PUBLICATIONS

Machine translation of KR101985224 of Jong et al. (Year: 2019).*
(Continued)

*Primary Examiner* — Brian W Cohen
(74) *Attorney, Agent, or Firm* — ScienBiziP, P.C.

(57) ABSTRACT

A titanium alloy product includes a titanium alloy substrate and a plurality of first holes defined in a surface of the titanium alloy substrate. The first holes have an opening on the surface of the titanium alloy substrate and an inner wall connecting with the opening, a diameter of the inner space is greater than a diameter of the opening. The product tensile strength of bonding between the titanium alloy product and a material part filled in the first holes is very high. A housing with the titanium alloy product and a method for manufacturing the titanium alloy product are also disclosed.

10 Claims, 18 Drawing Sheets

(51) Int. Cl.

| | |
|---|---|
| ***C23F 1/20*** | (2006.01) |
| ***C23F 17/00*** | (2006.01) |
| ***C25D 11/06*** | (2006.01) |
| ***C25D 11/10*** | (2006.01) |
| ***C25D 11/18*** | (2006.01) |
| ***C25D 11/24*** | (2006.01) |
| ***C25D 11/34*** | (2006.01) |
| ***C25F 3/08*** | (2006.01) |

(56) References Cited

FOREIGN PATENT DOCUMENTS

| | | | |
|---|---|---|---|
| CN | 112203444 | A | 1/2021 |
| CN | 112342604 | A | 2/2021 |
| KR | 101985224 | B1 * | 5/2019 |

OTHER PUBLICATIONS

"Concise Handbook of Magnesium Alloy Materials," by Liu Jing'an, published by Metallurgical Industry Press, p. 606, Aug. 31, 2016.

* cited by examiner

TITANIUM ALLOY PRODUCT, HOUSING, AND METHOD FOR MANUFACTURING THE SAME

CROSS-REFERENCE TO RELATED APPLICATIONS

This application claims all benefits accruing under 35 U.S.C. § 119 from Chinese Patent Application No. 202110298354.9, filed on Mar. 19, 2021, in the State Intellectual Property Office of China, the entire contents of which are incorporated herein by reference.

FIELD

The subject matter herein generally relates to metal materials, and more particularly, to a titanium alloy product, a housing, and a method of manufacturing the titanium alloy product.

BACKGROUND

Portable electronic products are widely used in daily life. The portable electronic product has high requirement on appearance and performance of the housing. Titanium alloy is often used as a material of the housing, since titanium alloy has high strength, low density, good mechanical properties, good toughness, and good corrosion resistance.

To prevent shielding of the antenna signal by the metal housing, the housing of the electronic product may include a main metallic part and a non-metallic part connected to the main part. To facilitate a connection between the main part and the non-metallic part, a surface treatment to form holes defined in the main part is needed. However, high toughness and good corrosion resistance of titanium alloy make applying a surface treatment on titanium alloy difficult, which may limit applications of titanium alloy in the housing.

SUMMARY

In view of the above situation, it is necessary to provide a titanium alloy product that can be effectively combined with other materials. A method of manufacturing the titanium alloy product, a housing including the titanium alloy product are also provided.

According to some embodiments, a titanium alloy product includes a titanium alloy substrate and a plurality of first holes defined in a surface of the titanium alloy substrate. At least one of the plurality of first holes has an opening on the surface of the titanium alloy substrate and an inner wall connecting with the opening, a longest segment of two points on a periphery of the opening is defined as segment A; a longest segment of two points on the inner wall is defined as segment B; a plane A defined by segment A and a point not on segment A but on the periphery of the opening is parallel to a plane B defined by segment B and a point not on segment B but on the inner wall; a length of segment B is greater of a length of segment A.

According to some embodiments, the titanium alloy product further includes a plurality of second holes disposed on an inner wall of the plurality of first holes, the inner wall of the plurality of first holes is further recessed to form the plurality of second holes, at least one of the plurality of the second hole includes a main body and a plurality of spikes, the plurality of spikes is formed radially on the main body; and the plurality of the second holes is formed radially in the inner wall of at least one of the plurality of the first holes.

According to some embodiments, a range of a median depth of the plurality of first holes is 35 μm to 60 μm.

According to some embodiments, the titanium alloy substrate is made of titanium aluminum alloy.

According to some embodiments, a depth of the plurality of first holes is in a range of 20 μm to 70 μm.

According to some embodiments, a hole-forming rate of the plurality of first holes is in a range of 30% to 60%.

According to some embodiments, the titanium alloy product further includes an aluminum alloy substrate connected to the titanium alloy substrate; and a plurality of third holes defined in a surface of the aluminum alloy substrate, wherein the surface of the aluminum alloy substrate is recessed to form the plurality of third holes, and at least one of the plurality of third holes includes a plurality of spikes formed radially in the inner wall of the at least one of the plurality of third holes.

According to some embodiments, a housing includes a titanium alloy product and a material part. The titanium alloy product includes a titanium alloy substrate and a plurality of first holes disposed on the titanium alloy substrate; at least one of the plurality of first holes has an opening on the surface of the titanium alloy substrate and an inner wall connecting with the opening, a longest segment of two points on a periphery of the opening is defined as segment A; a longest segment of two points on the inner wall is defined as segment B; a plane A defined by segment A and a point not on segment A but on the periphery of the opening is parallel to a plane B defined by segment B and a point not on segment B but on the inner wall; a length of segment B is greater of a length of segment A; and the material part is disposed in the plurality of first holes.

According to some embodiments, the titanium alloy product further includes a plurality of second holes, the second holes are radially disposed on an inner wall of the first holes; at least one of the plurality of the second hole includes a main body and a plurality of spikes, the plurality of spikes is formed radially on the main body; and the material body is further accommodated in the plurality of second holes.

According to some embodiments, the titanium alloy product further includes a depth of the plurality of first holes is in a range of 20 μm to 70 μm.

According to some embodiments, a method of manufacturing a titanium alloy product includes: applying a sandblasting treatment on a titanium alloy workpiece, the titanium alloy workpiece including a titanium alloy part; immersing the titanium alloy workpiece applied the sandblasting treatment into an etching solution, applying a voltage on the titanium alloy workpiece being an anode, to form a plurality of first holes defined in a titanium alloy part of the titanium alloy workpiece, thereby obtaining the titanium alloy product. The etching solution includes an organic liquid, a cosolvent, and a chloride; the chloride dissociates $Cl^-$ in the cosolvent, and the organic liquid and the cosolvent dissolve each other.

According to some embodiments, the titanium alloy part includes aluminum element; the etching solution further includes an alkaline additive or an acidic additive; the alkaline additive or the acidic additive reacts with the aluminum elements, $Cl^-$ in the chloride reacts with the titanium elements in the titanium alloy part to form the plurality of first holes and a plurality of second holes defined in the titanium alloy part; the plurality of second holes are radially disposed on an inner wall of the first holes, and the inner wall of the plurality of first holes is further recessed to form the plurality of second holes.

According to some embodiments, the voltage applied on the titanium alloy workpiece to generate a current density in the etching solution, the current density is in a range of 2 $A/dm^2$ to 15 $A/dm^2$.

According to some embodiments, the titanium alloy workpiece further includes an aluminum alloy part. Before applying the sandblasting treatment on the titanium alloy workpiece, the method further includes: immersing the titanium alloy workpiece in an electrolyte, applying a voltage on the titanium alloy workpiece as an anode to form an anodized film on the aluminum alloy part; the electrolyte is at least one selected from a group consisting of phosphoric acid, sulfuric acid, and oxalic acid; the voltage applied on the titanium alloy workpiece is in a range of 10 V to 30 V.

According to some embodiments, after immersing the titanium alloy workpiece into the etching solution, the method further includes immersing the titanium alloy workpiece into a corrosive solution to form a plurality of third holes defined in the aluminum alloy part. The corrosive solution includes a water, a chloride, and an inorganic acid; a concentration of the chloride in the corrosive solution is in a range of 10 g/L to 50 g/L, a concentration of the inorganic acid in the corrosive solution is in a range of 10 g/L to 100 g/L.

According to some embodiments, a ratio of the organic liquid to the cosolvent by volume is in a range of 2:1 to 10:1.

According to some embodiments, a relative dielectric constant of the organic liquid is in a range of 20 to 50.

According to some embodiments, a conductivity of the etching solution is in a range of 0.3 μS/cm to 30 μS/cm.

According to some embodiments, the etching solution further includes an alkaline additive or an acidic additive; the alkaline additive is at least one selected from a group consisting of an inorganic base and an organic base; the inorganic base is at least one selected from a group consisting of sodium hydroxide and potassium hydroxide.

According to some embodiments, the organic acid includes an oxalic acid; a molar ratio of $Cl^-$ dissociated from the chloride in the cosolvent to the oxalic acid is in a range of 1:1 to 5:1.

The present disclosure provides the titanium alloy product. The surface of the titanium alloy product has first holes, this increases the tensile strength and bonding between the titanium alloy product and the material part filled in the first holes, thereby increasing the bonding strength of the titanium alloy product and the material part.

BRIEF DESCRIPTION OF THE DRAWINGS

Implementations of the present disclosure will now be described, by way of example only, with reference to the attached figures.

DETAILED DESCRIPTION

Figure 1A:
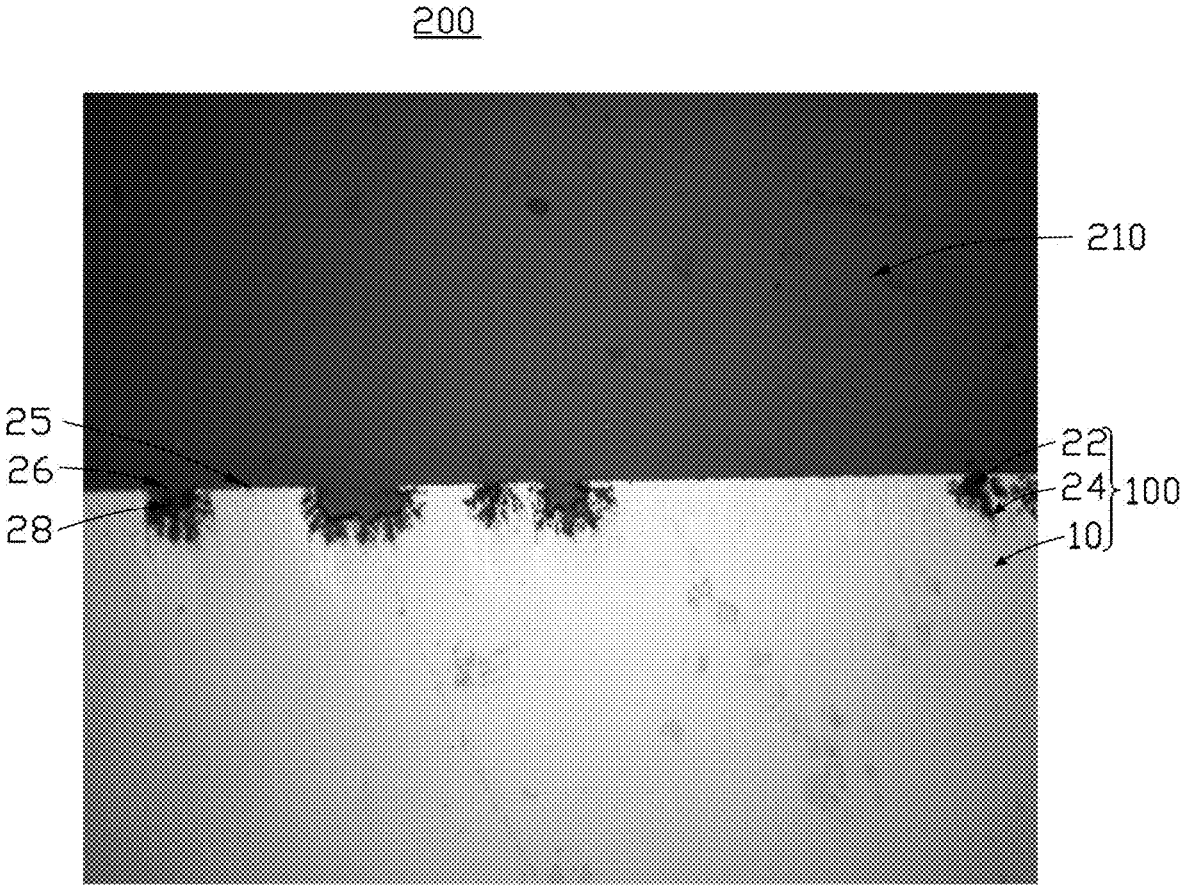
FIG. 1A is a cross-sectional micrograph wherein a material part is formed in first holes and second holes of a titanium alloy substrate, which is magnified 200 times taken by a Keyence laser microscope in accordance with some embodiments of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein.

The term "comprising," when utilized, means "including, but not necessarily limited to"; it specifically indicates open-ended inclusion or membership in the so-described combination, group, series, and the like. If no conflict, the following embodiments and features in the embodiments can be combined with each other.

An etching solution is provided. The etching solution can etch a titanium alloy during applied a voltage on the titanium alloy to form micropores of a certain shape on a surface 25 of the titanium alloy.

The etching solution includes an organic liquid, a cosolvent, and a chloride.

The organic liquid is miscible with the cosolvent. In some embodiments, the organic liquid is at least one selected from a group consisting of propylene glycol, glycerol, ethylene glycol, diethylene glycol, lactic acid, and triethanolamine. The etching solution is homogenous solution, so that ions which corrode the titanium alloy in the etching solution are uniformly applied to the titanium alloy.

A relative dielectric constant of the organic liquid is about in a range of 20 to 50, to reduce a conductivity of the etching solution, so as to provide a stable environment for a formation of the micropores on the titanium alloy during the etching process.

The cosolvent is water which dissolves the chloride to dissociate chloride ion ($Cl^-$), thereby etching the titanium alloy during the voltage application.

The water includes ordinary water or deionized water. The water may also be water produced by adding a compound containing crystal water in the etching solution. Water can dissociate the chloride to produce chloride ion ($Cl^-$).

A ratio of the organic liquid to the cosolvent by volume is about in a range of 2:1 to 10:1. The hole-forming rate of organic liquid to cosolvent has a great impact on the formation of holes. A proper ratio is conducive to the formation of holes with proper diameter, depth, and hole-forming rate. The hole-forming rate defines an area ratio of a plane area of the holes on the surface of the substrate with an area of the substrate surface. It should be noted that the plane area of the holes is the area of the opening surface of the holes, and is not the area of the inner wall surface area. When the hole-forming rate is too high, that is, when there is more organic liquid and less cosolvent, more chloride used for corrosion purposes cannot be dissolved. When the hole-forming rate is too small, that is, there is less organic liquid and more cosolvent, the surface of the titanium alloy will be corroded and holes of reasonable size will not be formed.

The chloride is a substance capable of dissociating $Cl^-$ in the cosolvent. The chloride is at least one selected from a group consisting of sodium chloride, ferric chloride, cupric chloride, and potassium chloride.

A conductivity of the etching solution is about in a range of 0.3 μS/cm to 30 μS/cm. The conductivity of the etching solution is of a low order, that is, the resistance of the is etching solution is large, providing a small current density in the process of applying a voltage, so that the etching solution corrodes the titanium alloy slowly, and the current density is restricted from being too high, high current density would cause uncontrollable reaction and form holes not meeting the production requirements.

Electrochemical corrosion of titanium alloy is carried out in an organic environment. The organic environment provides an environment for corrosion with high voltage and low current density. In the organic environment, Ti—O bond in the titanium alloy can be polarized, so that, when dissociated from the etching solution, the $Cl^-$ can easily destroy a chemical bond of Ti—O, thereby forming micropores of a specific shape. In some embodiments illustrated in FIGS. 1A, 1B, and 1C, a housing 200 is provided. The housing 200 is used for consumer electronic devices. The consumer electronic devices may be consumer electronic products, power tools, drones, energy storage devices, power devices, and the like. The housing 200 includes a titanium alloy product 100 and a material part 210. The titanium alloy product 100 is corroded to achieve the titanium alloy substrate 10 and a plurality of first holes 22 formed on a surface 25 of the titanium alloy substrate 10. At least one of the plurality of first holes 22 has an opening 26 on the surface 25 of the titanium alloy substrate 10 and an inner space 28 which is in communication with the opening 26. A longest segment of two points on a periphery of the opening 26 is defined as segment A; a longest segment of two points on the inner wall is defined as segment B; a plane A defined by segment A and a point not on segment A but on the periphery of the opening 26 is parallel to a plane B defined by segment B and a point not on segment B but on the inner wall; a length of segment B is greater of a length of segment A. That is, the diameter of the first holes 22 gradually increases and then gradually decreases from the bottom of the holes to the opening 26, allowing a greater tensile strength between the titanium alloy and the material part 210 subsequently formed in the first holes 22.

Figure 2A:
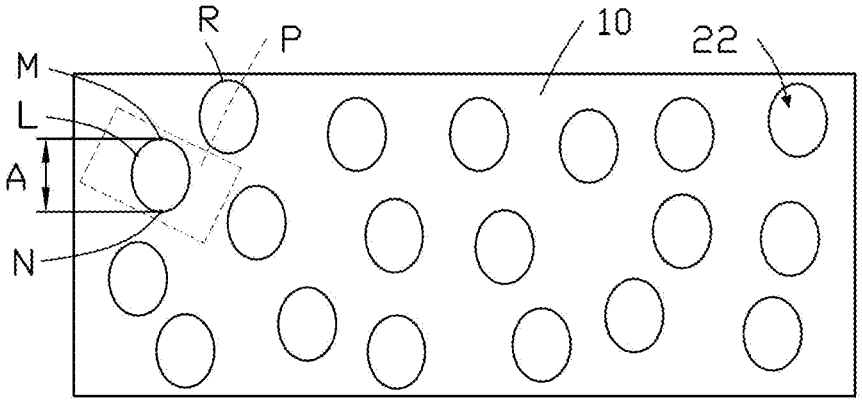
FIG. 2A is a simplified top view of a titanium alloy substrate, in accordance with some embodiments of the present disclosure.
Figure 2B:
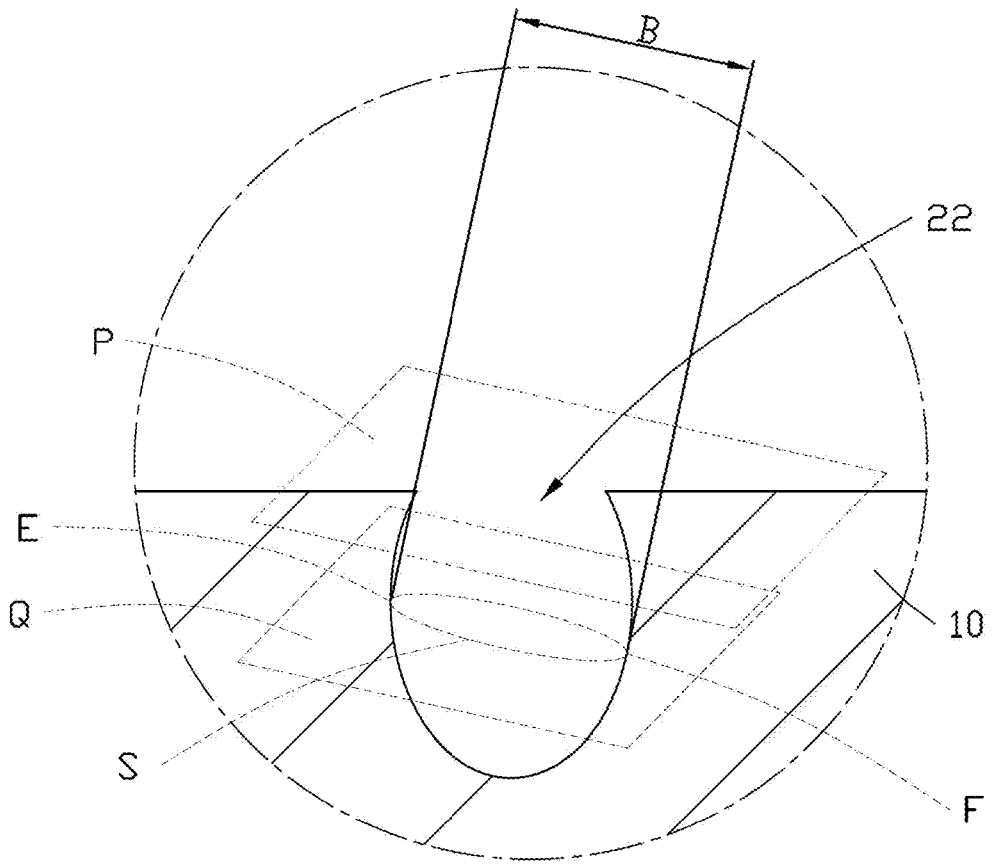
FIG. 2B is a simplified cross-sectional side view of first hole of the titanium alloy substrate of FIG. 2A

Referring to FIGS. 2A and 2B, a periphery of the opening 26 of each of the first holes 22 is defined as R. M and N are two different points on the periphery R, and a distance between the two points M and N is a length of a first line segment MN. The length of the first line segment MN is equal to a longest straight-line distance between any two points on the periphery R. The first line segment MN is with a length A. L is a point on the periphery R, and L is different from the points M and N. A plane P of the opening 26 is where the three points M, N, and L are located. A cross-sectional plane Q of the first holes 22 is parallel to the plane P. A periphery S is where the plane Q and an inner wall of each of the first holes 22 intersect. E and F are two different points on the periphery S, and a distance between the two points E and F is a length of a second line segment EF. The length of the second line segment EF is the longest straight-line distance between any two points on the periphery S. The second line segment EF is with a length B.

There is a plurality of plane Q and a plurality of periphery S, and the length B is the maximum value of the longest straight-line distances in all of the peripheries S, each of the longest straight-line distances is defined between two points on each periphery S. That is, if a longest straight-line distance between two points on a periphery S1 is B1, a longest straight-line distance between two points on a periphery S2 is B2, a longest straight-line distance between two points on a periphery S3 is B3, . . . and a longest straight-line distance between two points on a periphery Sn is Bn (n is an integer value), a value of B is the maximum value of B1, B2, B3 . . . and Bn.

The longest distance A between two points on the periphery R is less than the longest distance B between two points on the periphery S.

Second holes 24 are also formed on the titanium alloy. The second holes 24 are radially disposed on an inner wall of the first holes 22. At least one of the plurality of the second hole 24 includes a main body 241 and a plurality of spikes 243, the plurality of spikes 243 is formed radially on the main body 241. The second holes 24 are formed in the wall of the first holes 22 in a radial direction toward the main body 241 of the titanium alloy. The inner wall of the second holes 24 presents an uneven spike structure and is rendered very rough and non-smooth. Since the first holes 22 work to present a constricted structure and the inner wall of the second holes 24 works to present a radial spike structure, the tensile strength between the titanium alloy and the material part 210 is stronger, and the bonding is further improved.

In some embodiments, the second holes 24 may also present structure resembling coral, the inner wall of the plurality of first holes 22 being further recessed to form the second holes 24. The surface of the coral-like structure also has an uneven spike structure, which enhances the bonding force between the titanium alloy and the material part 210.

In some embodiments, the titanium alloy substrate is made of titanium aluminum alloy, and the etching solution also includes an alkaline additive or an acidic additive to provide an alkaline ($OH^-$) or acidic ($H^+$) etching environment for the titanium alloy. In the process of applying a voltage on the titanium alloy, on one hand, $OH^-$ or $H^+$ can react with the aluminum oxide on the titanium alloy, generating small areas of negative polarity and small areas of positive polarity on the titanium alloy, and improves the morphological difference of the titanium alloy. On the other hand, in the electrochemical corrosion process. $OH^-$ or $H^+$ will corrode the titanium-aluminum grain boundary and accelerate the etching reaction.

The alkaline additive can be at least one selected from a group consisting of an inorganic base and an organic base. The inorganic base can be at least one selected from a group consisting of sodium hydroxide and potassium hydroxide. The organic base can be at least one selected from a group consisting of sodium methanolate, potassium ethylate, and potassium tert-butoxide.

The acidic additive can be at least one selected from a group consisting of inorganic acid and organic acid. The inorganic acid can be at least one selected from a group consisting of hydrochloric acid, sulfuric acid and phosphoric acid. The organic acid can be at least one selected from a group consisting of citric acid and oxalic acid.

In some embodiments, the acidic additive is an oxalic acid. The oxalic acid can be oxalic acid compound added to the etching solution, or it can be provided by oxalate and inorganic acid. For example, sodium oxalate and sulfuric acid can be added to the etching solution to form oxalic acid. A molar ratio of $Cl^-$ dissociated from the chloride in the cosolvent to the oxalic acid mix is about in a range of 1:1 to 5:1. The oxalic acid dissociates oxalate ions in the etching solution, and the oxalate ions react with titanium in the titanium alloy to form water-soluble titanium oxalate, further accelerating the reaction between the etching solution and the titanium elements in the titanium alloy, and facilitating the formation of the first holes 22 with a greater depth.

Figure 3:
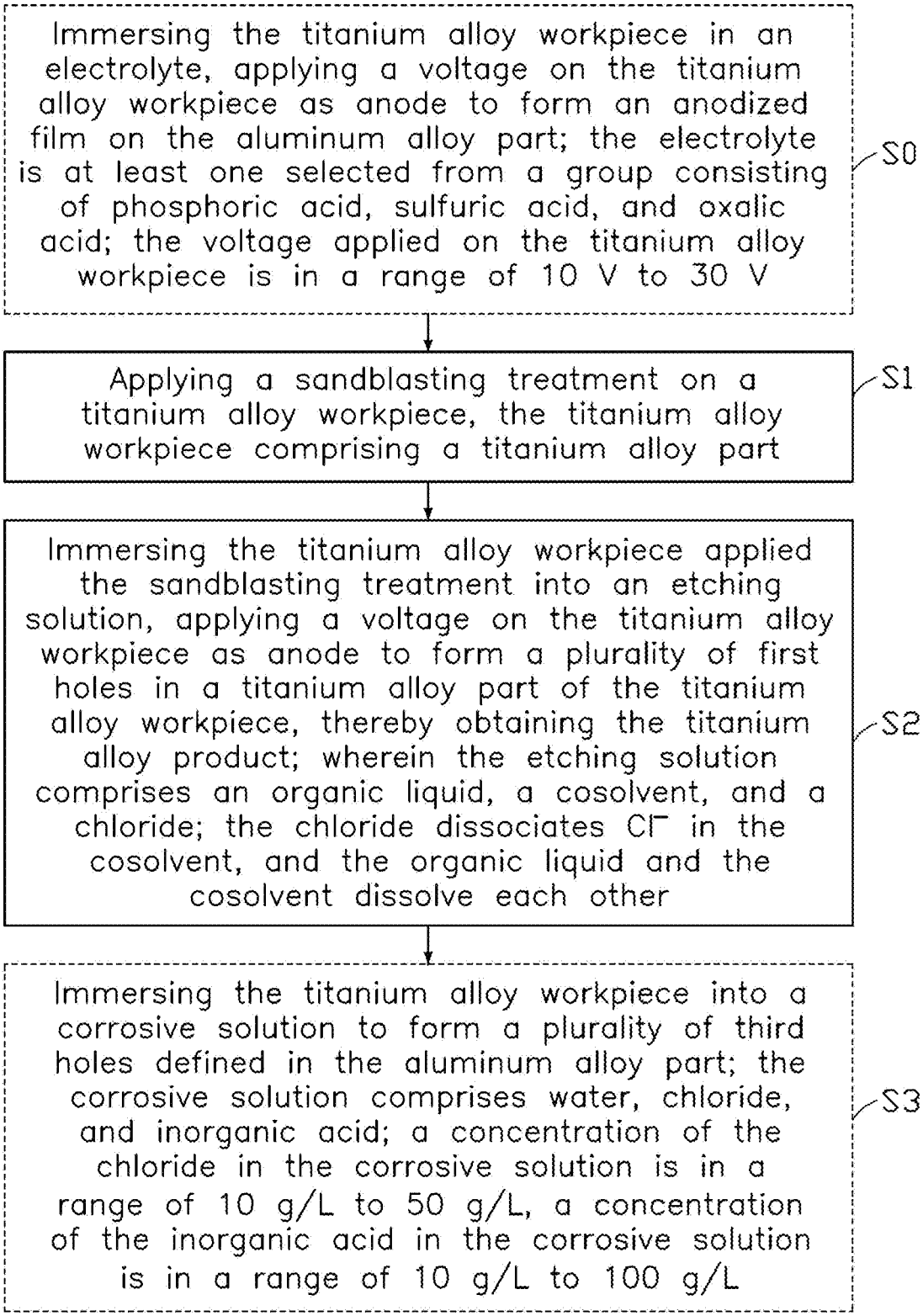
FIG. 3 illustrates a flowchart of a method of manufacturing a titanium alloy product, in accordance with some embodiments of the present disclosure.

In some embodiments as illustrated in FIG. 3, a method of manufacturing the titanium alloy product 100 includes following steps.

Step S1: applying a sandblasting treatment on a titanium alloy workpiece to remove oxide film on the titanium alloy workpiece and to form micropores on the titanium alloy workpiece to increase the surface roughness of the titanium alloy workpiece. The titanium alloy workpiece including a titanium alloy part.

A material used for the sandblasting treatment can be at least one selected from a group consisting of aluminum oxide, zirconium dioxide, iron oxide, and the like.

In some embodiments, particle size of the material used for the sandblasting treatment is about in a range of 80 μm to 120 μm. A pressure of a spray gun for the sandblasting treatment is about in the range of 0.15 MPa to 0.3 MPa. A time period of the sandblasting treatment is about in the range of 20 s to 60 s.

The diameter of the micropores formed during the sandblasting treatment is related to the parameters during the sandblasting treatment.

After the sandblasting treatment, the method further includes cleaning the titanium alloy to remove impurities such as oil stains and oxides on the titanium alloy, which allows smooth progress of the etching reaction.

Step S2: immersing the titanium alloy workpiece applied the sandblasting treatment into the etching solution, applying a voltage on the titanium alloy workpiece as an anode. The first holes 22 are formed on the titanium alloy component in the titanium alloy workpiece to form the titanium alloy product 100, and the remaining part of the titanium alloy is the titanium alloy substrate 10. The etching solution includes organic liquid, cosolvent, and chloride. The chloride can dissociate $Cl^-$ in the cosolvent, and the organic liquid and the cosolvent can dissolve each other.

During applying the voltage, the etching solution etches the titanium alloy workpiece to form the first holes 22 during the sandblasting treatment. At least one of the pluralities of first holes 22 has an opening 26 on the surface 25 of the titanium alloy substrate 10. A longest segment of two points on a periphery of the opening 26 is defined as segment A; a longest segment of two points on the inner wall is defined as segment B; a plane A defined by segment A and a point not on segment A but on the periphery of the opening 26 is parallel to a plane B defined by segment B and a point not on segment B but on the inner wall; a length of segment B is greater of a length of segment A.

In some embodiments, when the voltage applied on the titanium alloy workpiece generates a current density in the etching solution, the current density is about in a range of 2 $A/dm^2$ to 15 $A/dm^2$. The current density must not be too large, causing uncontrollable etching reaction. The current density must not be too small, when the etching rate is too slow and reduces the production efficiency.

In some embodiments, the voltage applied on the titanium alloy workpiece is about in a range of 15 V to 40 V. A temperature of the etching solution is about in a range of 40 degrees Celsius to 80 degrees Celsius. A time period of applying a voltage is about in a range of 5 min to 60 min.

In some embodiments, by increasing the time period of applying a voltage (for example, more than 10 min), second holes 24 can be formed on the first holes 22. The second holes 24 are disposed on the inner wall of the first holes 22. At least one of the plurality of the second hole 24 includes a main body 241 and a plurality of spikes 243, the plurality of spikes 243 is formed radially on the main body 241; and the plurality of the second holes 24 is formed radially in the inner wall of at least one of the plurality of the first holes 22. The shapes of the first holes 22 and the second holes 24 are related to the elements in the titanium alloy, the composition of the etching solution, and the etching parameters. The second holes 24 are small holes, which are mainly caused by the composition of the titanium alloy component, and which relates to the metastable form of the holes. Since the inner wall of the first holes 22 is not smooth, when the time period is increased, the oxygen content in part of the inner wall of the first holes 22 is lower, which is beneficial to the anode dissolution of titanium. In addition, $Cl^-$ will accumulate in part of the inner wall of the first holes 22, resulting in an increase in the concentration of $Cl^-$, which is further conducive to corrosion, thereby forming a radial spike or coral-like second holes 24.

A model of the titanium alloy can be selected from a group consisting of Ti-6Al-4V, Ti-5A-2.5Sn, Ti-2Al-2.5Zr, and the like. The model of the titanium alloy can be selected according to the use environment of the titanium alloy product 100. In some embodiments, the model of the titanium alloy is Ti-6Al-4V which includes aluminum.

In some embodiments, the titanium alloy part further includes aluminum elements, and the etching solution further includes an alkaline additive or an acidic additive. The alkaline additive or the acidic additive reacts with the aluminum elements, and $Cl^-$ in the chloride reacts with the titanium elements in the titanium alloy part to form the first holes 22 and the second holes 24 on the titanium alloy part.

In some embodiments, the titanium alloy workpiece further includes an aluminum alloy part. The aluminum alloy part is connected to the titanium alloy part. Before applying the sandblasting treatment on the titanium alloy workpiece, the method further includes following step.

Step S0: immersing the titanium alloy workpiece in an electrolyte, applying a voltage on the titanium alloy workpiece as an anode to form an anodized film on the aluminum alloy part of the titanium alloy workpiece.

In some embodiments, the electrolyte can be at least one selected from a group consisting of phosphoric acid, sulfuric acid, and oxalic acid. A concentration of the electrolyte is about in a range of 100 g/L to 200 g/L. The voltage applied on the titanium alloy workpiece is about in a range of 10 V to 30 V. A time period of applying a voltage is about in a range of 5 min to 30 min. A thickness of the anodized film formed on the aluminum alloy part is 15 μm to 20 μm.

In the step of forming the anodized film on the aluminum alloy part, an anodized film will also form on the titanium alloy part. Because the chemical stability of titanium alloy is better than that of aluminum alloy, the anodized film formed on the titanium alloy part is thinner than the anodized film on the aluminum alloy part. Before the sandblasting treatment, the anodized film on the aluminum alloy is shielded to prevent damage to the anodized film on the aluminum alloy part during the sandblasting treatment. During the sandblasting treatment, it is the anodized film formed on the titanium alloy which is pierced to facilitate the formation of the first holes 22 on the titanium alloy part during the etching process.

In some embodiments, after the anodized film is formed and before the sandblasting treatment, the method further includes applying a rubber plug to cover the anodized film formed on the aluminum alloy part to prevent damage to the anodized film formed on the aluminum alloy part during the sandblasting treatment. After the sandblasting treatment, remove the rubber plug.

In some embodiments, after immersing the titanium alloy workpiece into the etching solution, the method further includes the following step.

Step S3: immersing the titanium alloy workpiece into a corrosive solution to form a plurality of third holes defined in a surface of aluminum alloy part of the titanium alloy workpiece. The third holes 32 are coral-shaped. The surface of the aluminum alloy substrate 30 is recessed to form the plurality of third holes 32. The corrosive solution includes a water, a chloride, and an inorganic acid. A concentration of the chloride in the corrosive solution is about in a range of 10 g/L to 50 g/L. A concentration of the inorganic acid in the corrosive solution is about in a range of 10 g/L to 100 g/L.

The titanium alloy part is etched to form a titanium alloy substrate, and the aluminum alloy part is etched to form an aluminum alloy substrate.

Figure 1B:
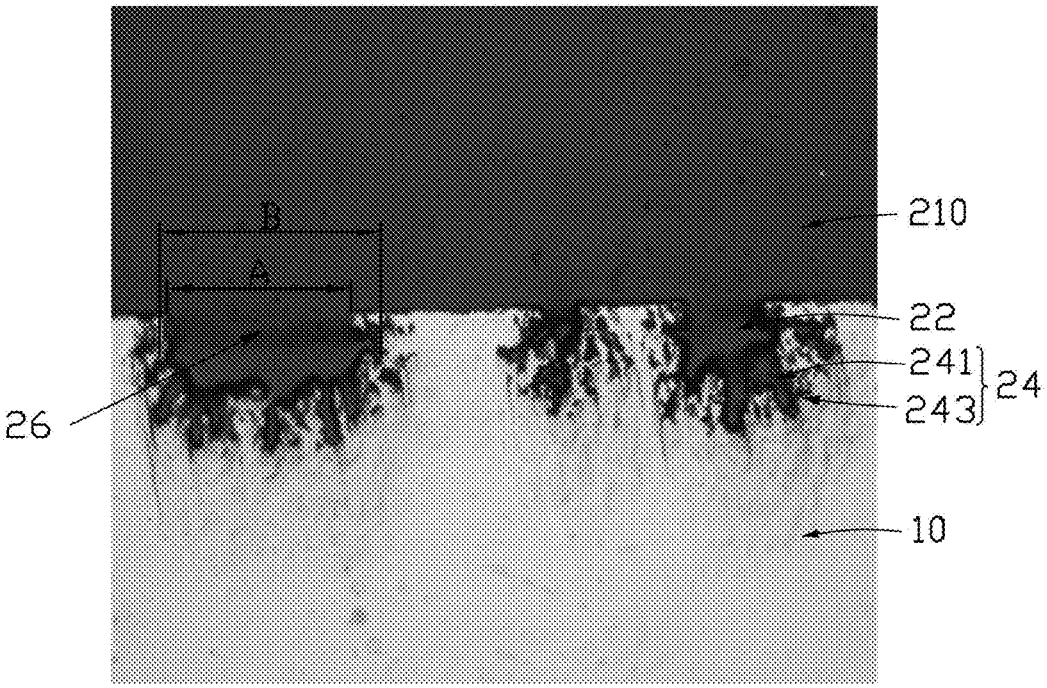
FIG. 1B is a cross-sectional micrograph of FIG. 1A magnified 500 times.
Figure 1C:
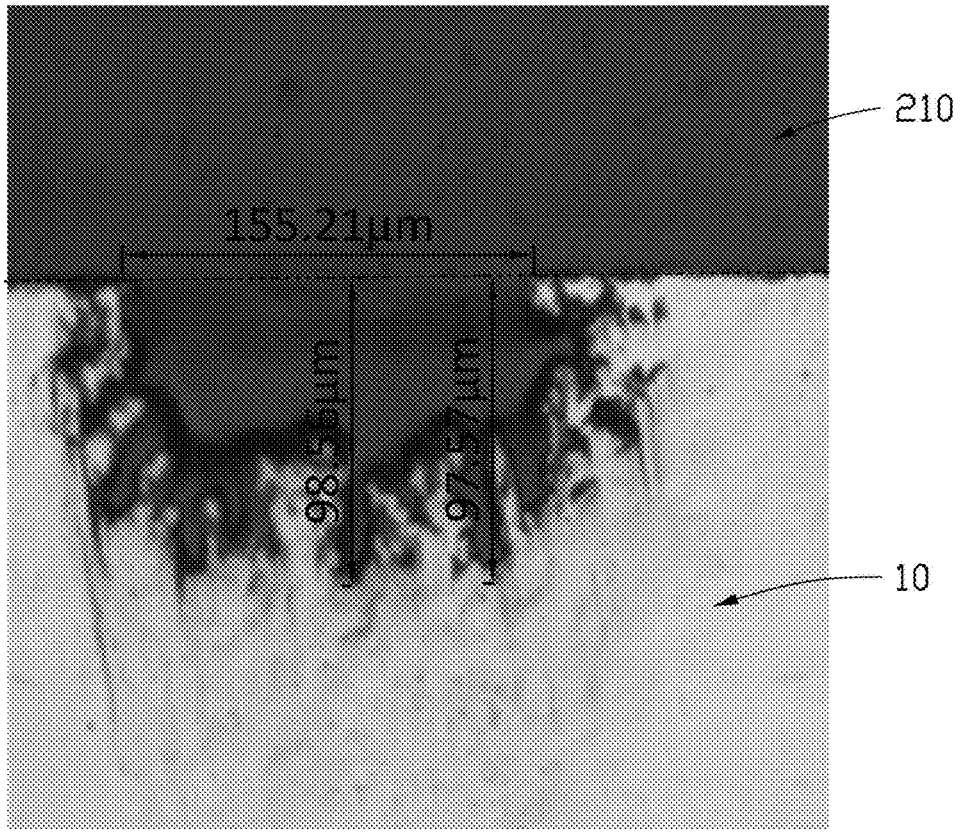
FIG. 1C is a cross-sectional micrograph of FIG. 1A magnified 1000 times.

In some embodiments illustrated in FIGS. 1A, 1B, and 1C, show cross-sections of the material part 210 formed in the first holes 22 of the etched titanium alloy (that is, the titanium alloy substrate 10). At least one of the plurality of first holes 22 has an opening 26 on the surface 25 of the titanium alloy substrate 10 and an inner space 28 communicating with the opening 26, and a diameter of the inner space 28 is greater than a diameter of the opening 26.

In some embodiments illustrated in FIG. 1A, the titanium alloy substrate 10 also has second holes 24. The second holes 24 are disposed on the inner wall of the first holes 22 (large hole). The second holes 24 have a radial spike structure or a coral-like structure. That is, the large holes sleeve the small holes, which increases a contact area between the titanium alloy substrate 10 and the material part 210 subsequently formed in the first holes 22, and increases the tensile strength between the titanium alloy substrate 10 and the material part 210. The second holes 24 are radial, the direction of the second holes 24 are anisotropic, which further increases the tensile strength between the titanium alloy substrate 10 and the material part 210. FIGS. 1A, 1B, and 1C show cross-sections of the titanium alloy after etching. Although in the cross-sectional micrograph, the first holes 22 and part of the second holes 24 form a straight hole from top to bottom. Due to the different position of the profile, the actual projection of the opening 26 of the first holes 22 does not necessarily fall on part of the opening of the second holes 24. Therefore, when the white light interferometer measures the depth of the first holes 22, it will not be affected by the depth of the second holes 24.

Figure 4:
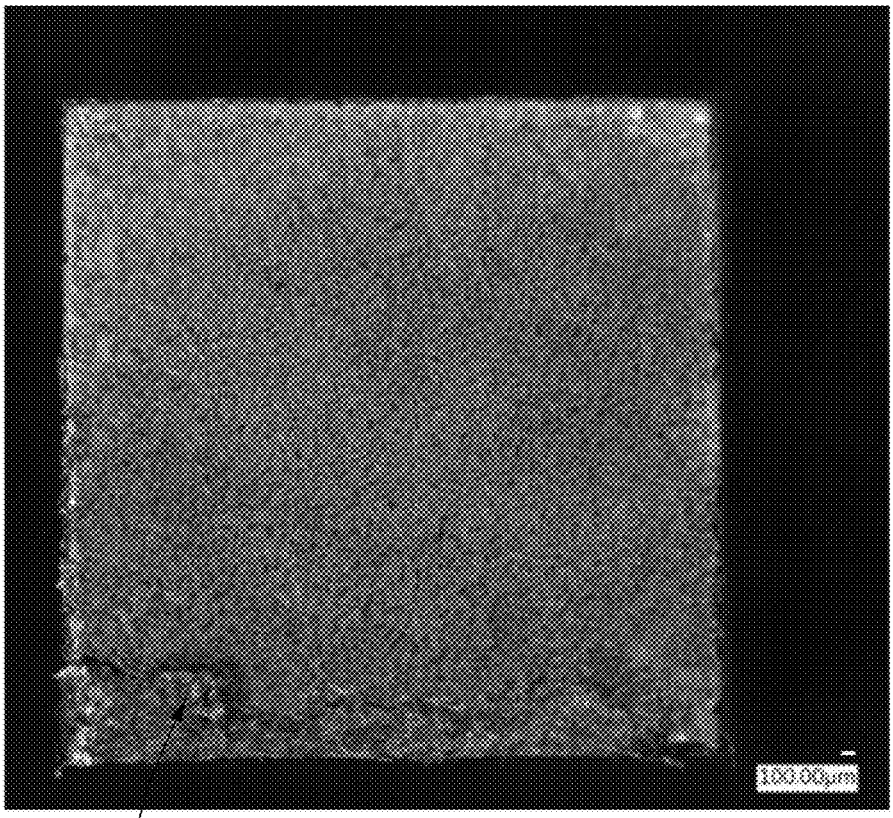
FIG. 4 is a micrograph wherein a part of the material part separated from the titanium alloy substrate, leaving other part of the material part in the first holes and the second holes, which is taken by a Keyence laser microscope, in accordance with some embodiments of the present disclosure.
Figure 5:
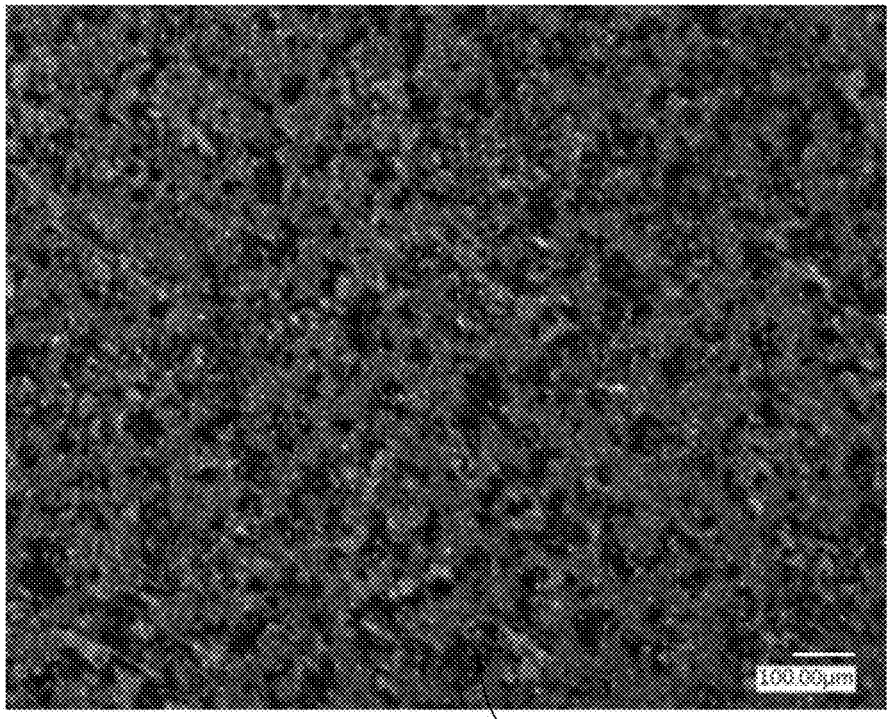
FIG. 5 is an enlarged section of FIG. 4.
Figure 6:
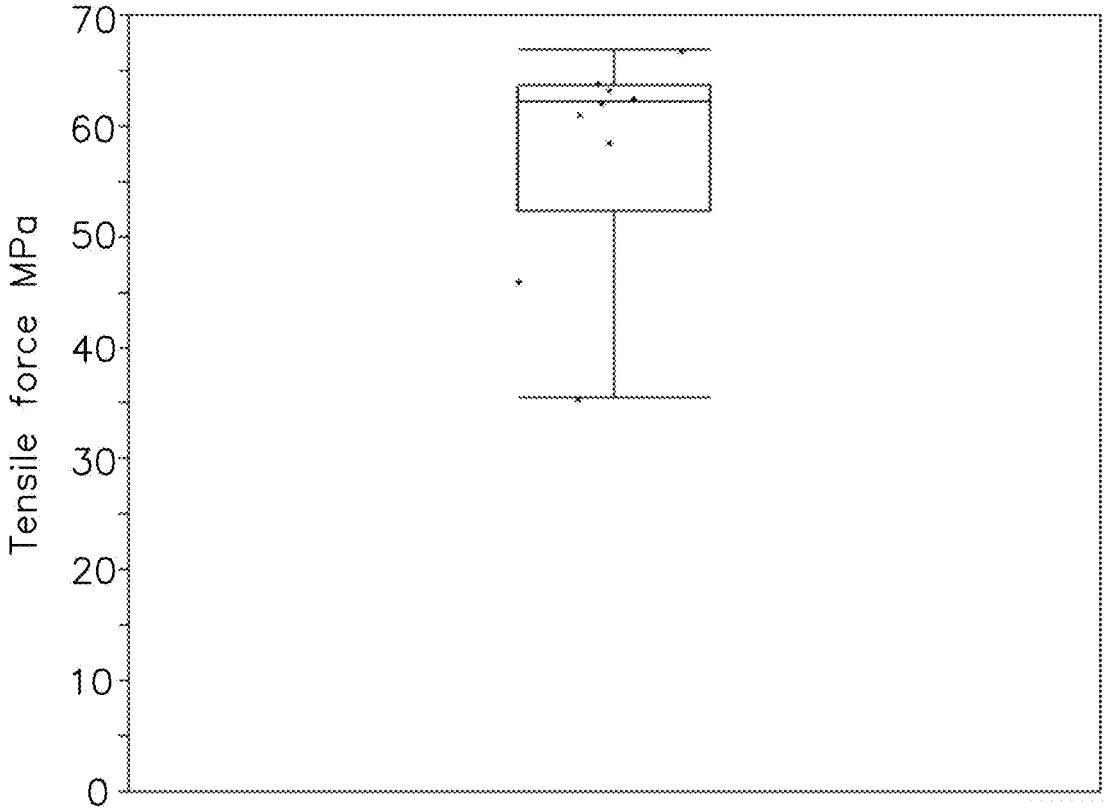
FIG. 6 is data of tensile strength required to separate the material part from the titanium alloy substrate, in accordance with some embodiments of the present disclosure.
Figure 7:
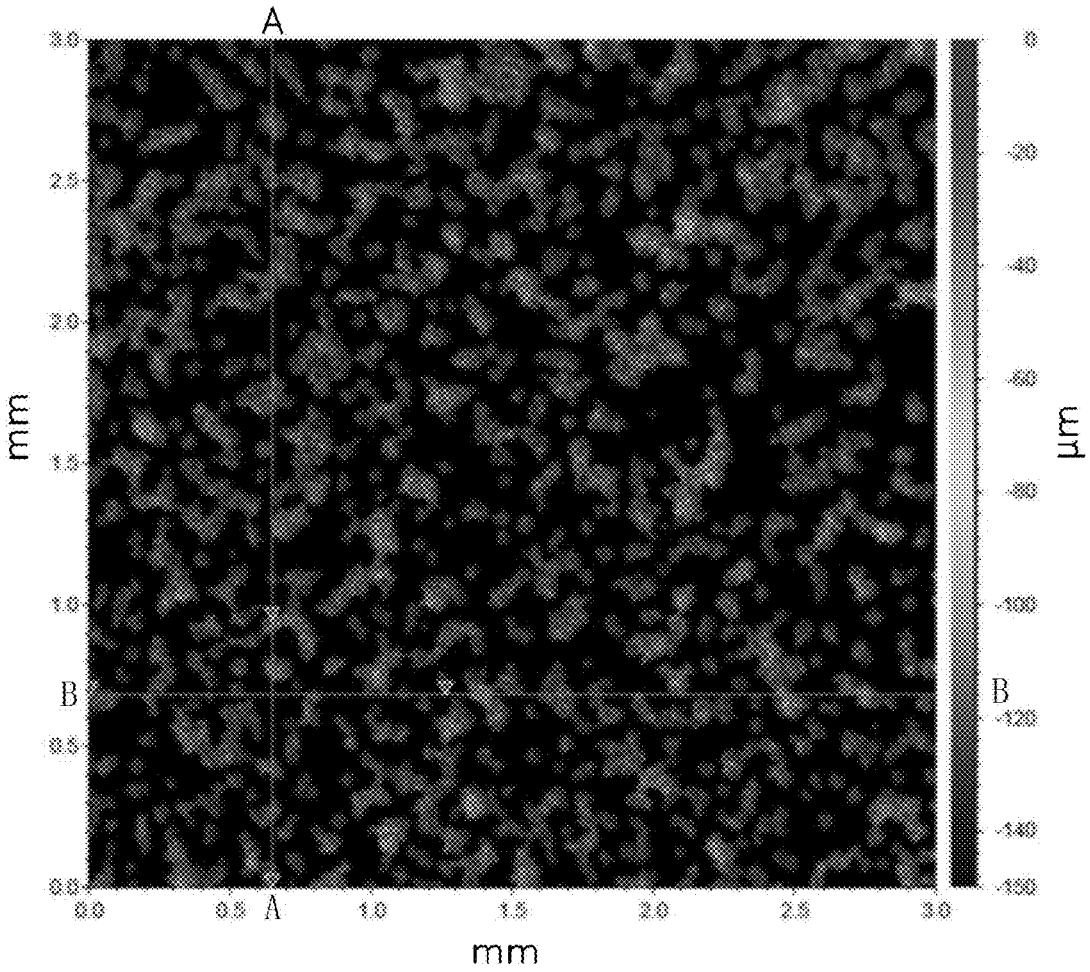
FIG. 7 is a photograph wherein the first holes formed on the titanium alloy substrate, which is taken by a white light interferometer, in accordance with some embodiments of the present disclosure.
Figure 8:
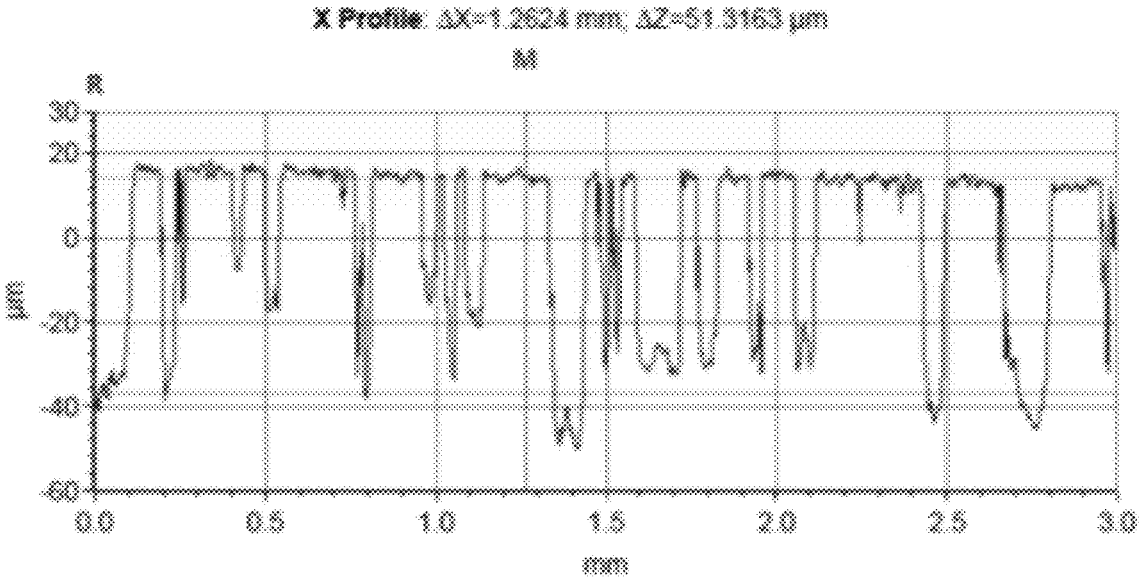
FIG. 8 illustrates a schematic diagram of a depth of the first holes tested along line A-A on the picture in FIG. 7.
Figure 9:
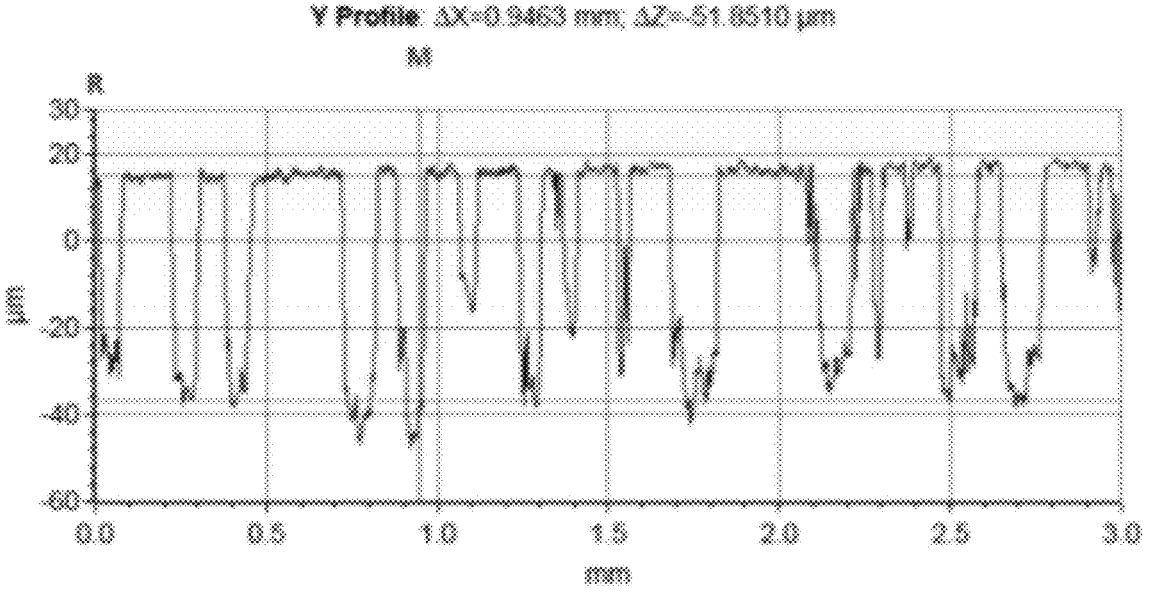
FIG. 9 illustrates a schematic diagram of a depth of the first holes tested along line B-B on the picture in FIG. 7.
Figure 10:
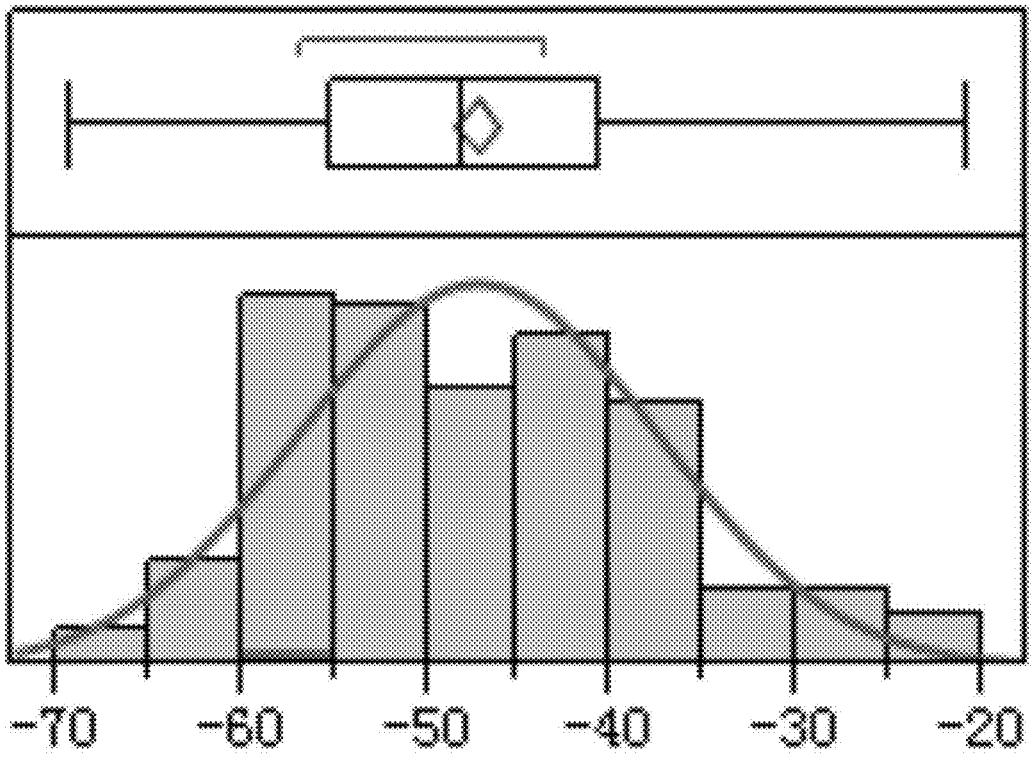
FIG. 10 illustrates hole depth distribution of the first holes, which is calculated according to the depths of FIG. 8 and FIG. 9.

In some embodiments illustrated in FIGS. 4, and 5, after the material part 210 is formed in the first holes 22, the material part 210 is separated from the titanium alloy substrate 10, and the material part 210 remains in the first holes 22. Referring to FIG. 5, a large amount of the material part 210 remains in the first holes 22, which proves that the bonding force between the material part 210 and the titanium alloy substrate 10 is relatively strong. FIG. 6 is a tensile strength data to separate the material part 210 and the titanium alloy substrate 10. Compared with a conventional force of 20 MPa, the tensile strength in this embodiment is able to withstand much stronger force than 20 MPa. Referring to FIGS. 5, and 6, during a tensile test, due to the first holes 22 with a neck-like structure being on the titanium alloy substrate 10, the bonding force between the material part 210 and the titanium alloy substrate 10 is relatively strong. When the material part 210 and the titanium alloy substrate 10 are forcefully pulled apart, the tensile strength required is close to the fracture strength of the material part 210 itself, so the tensile strength between the material part 210 and the titanium alloy substrate 10 is much higher than 20 MPa. In addition, due to the first holes 22 of the constricted structure, the material part 210 in the first holes 22 can mostly remain in the first holes 22 when the material part 210 is separated from the titanium alloy substrate 10.

A depth of the first holes 22 is about in a range of 20 μm to 70 μm. A range of a median depth of the plurality of first holes 22 is 35 μm to 60 μm. A hole-forming rate of the plurality of first holes 22 is about in a range of 30% to 60%. The holes formed on the titanium alloy by the above method are deeper, larger in diameter, and moderate in hole-forming rate. It is beneficial to form a low-fluidity, high-strength PA glue (a single-component nylon special glue with a polyethylene-based polymer as the main body) in the first holes 22, and improve the application range of the titanium alloy substrate 10. The etching solution used in the method does not contain fluorine components, and the etching environment is mild and environmentally friendly.

In some embodiments, as illustrated in FIGS. 7 to 10, a titanium alloy product 100 is formed after the titanium alloy etched by the method. A white light interferometer is used to test the depth of the first holes 22 on the titanium alloy. It can be seen from FIG. 10 that evenly distributed first holes 22 are formed on the titanium alloy. The depth of the first holes 22 is mostly 30 μm to 60 μm. The white light interferometer can only measure the depth of holes which are straight, so the main measurement is the depth of the first holes 22, not the depth of the first holes 22 plus the second holes 24.

Figure 11:
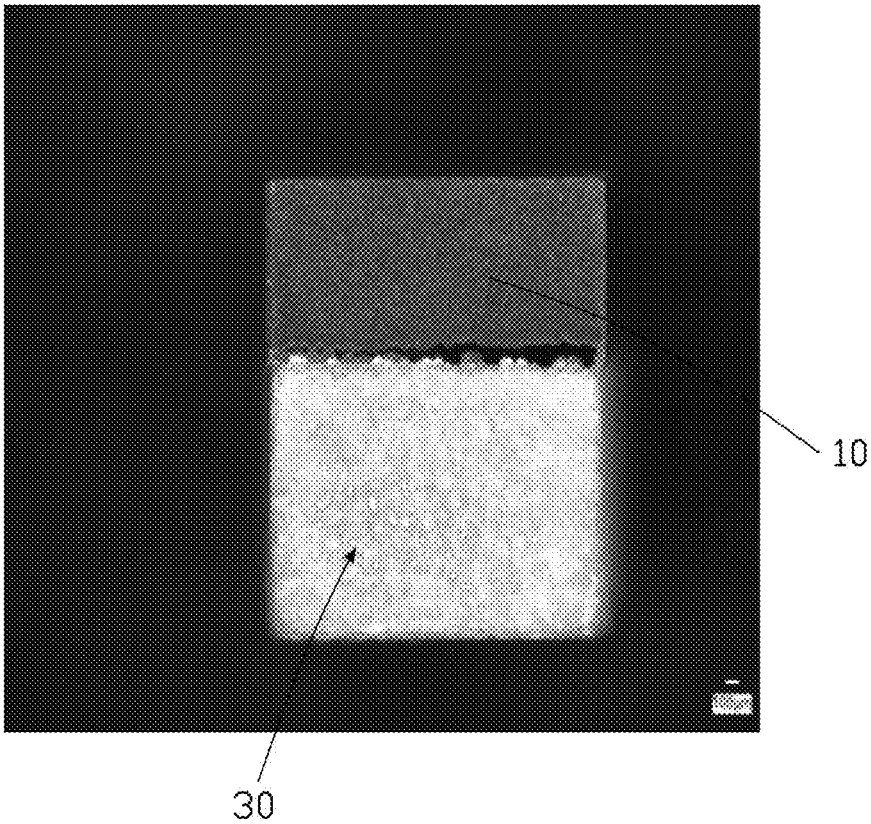
FIG. 11 is a micrograph of a titanium alloy product taken by a Keyence laser microscope, in accordance with some embodiments of the present disclosure.
Figure 12:
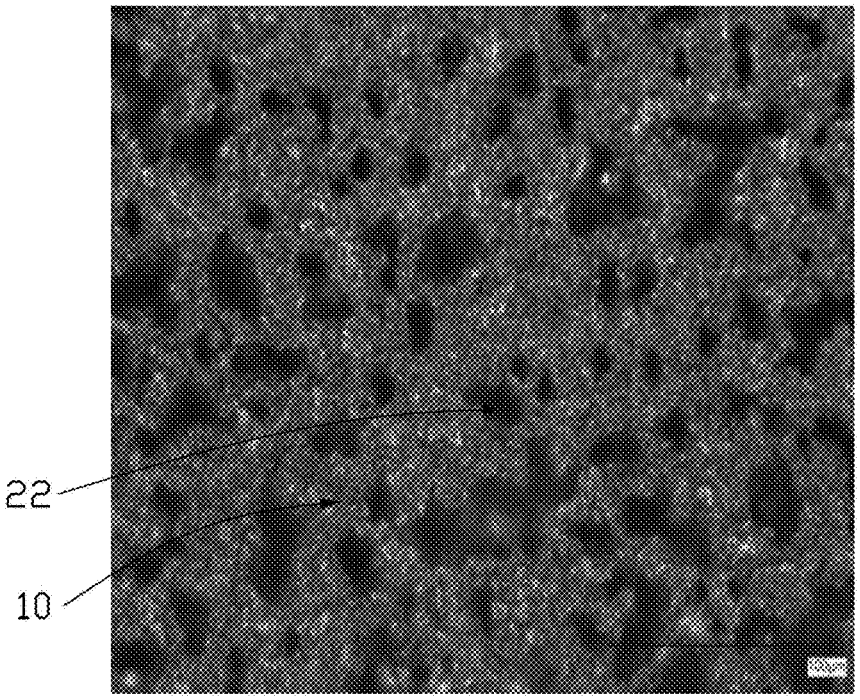
FIG. 12 is an enlarged view of the titanium alloy substrate and the first holes formed on the titanium alloy substrate in FIG. 11.
Figure 13:
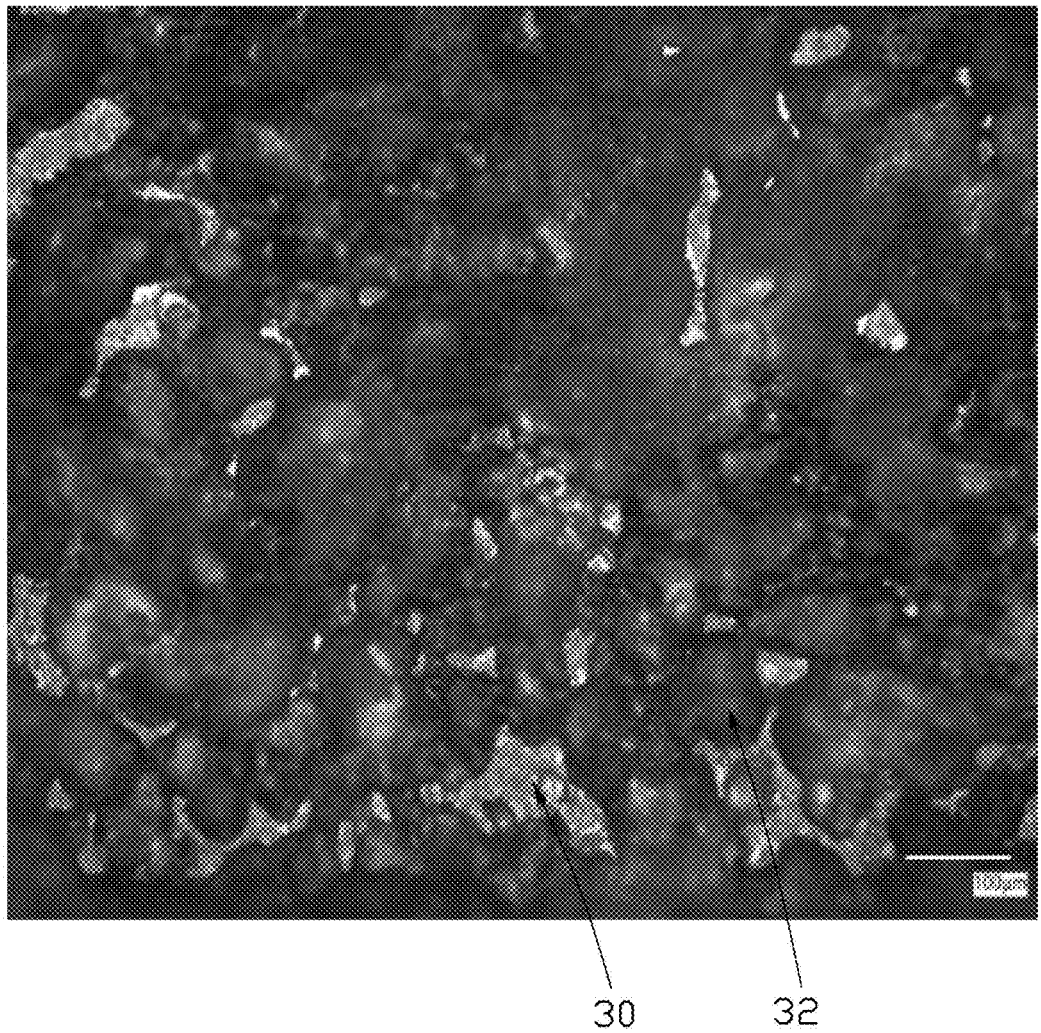
FIG. 13 is an enlarged view of the aluminum alloy substrate and third holes formed on the aluminum alloy substrate in FIG. 11.

In some embodiments, as illustrated in FIGS. 11 to 13, the titanium alloy product 100 further includes an aluminum alloy substrate 30. Referring to FIG. 11, the aluminum alloy substrate 30 is connected to the titanium alloy substrate 10. Referring to FIG. 12, The first holes 22 are disposed on the titanium alloy substrate 10. Referring to FIG. 13, the third holes 32 are disposed on the aluminum alloy substrate 30. The third holes 32 have a coral-like structure, and the third holes 32 are used for accommodating the material part 210.

The titanium alloy product 100 includes a titanium alloy substrate 10 and first holes 22 disposed on the titanium alloy substrate 10. At least one of the plurality of first holes 22 has an opening 26 on the surface 25 of the titanium alloy substrate 10 and an inner space 28 communicating with the opening 26, a diameter of the inner space 28 is greater than a diameter of the opening 26.

The titanium alloy substrate 10 is formed by etching a titanium alloy.

In some embodiments illustrated in FIGS. 1A, 1B, and 1C, a housing 200 is provided. The housing 200 is used for consumer electronic devices. The consumer electronic devices may be consumer electronic products, power tools, drones, energy storage devices, power devices, and the like.

The housing 200 includes the titanium alloy product 100 and a material part 210. At least part of the material part 210 is disposed in the first holes 22. A material of the material part 210 is at least one selected from a group consisting of metal, polymer, ceramic, and glass.

Hereinafter, the disclosure will be described through specific embodiments. Before electrochemical etching, the titanium alloy undergoes a cleaning step to remove impurities such as oil stains and oxides on the titanium alloy.

The step of cleaning was done by placing the titanium alloy in a degreasing agent R100 at a temperature of 55 degrees Celsius and a concentration of 50 g/L for degreasing treatment for 5 minutes, and then washing with water, and dried. Spraying aluminum oxide with a particle size of 100 μm for the sandblasting treatment. A pressure of a spray gun for the sandblasting treatment was 0.2 MPa. A time period of the sandblasting treatment was 60 s. After ultrasonic washing at 80 Hz for 5 minutes, soaking in sulfuric acid for 5 minutes at room temperature. Water washing and drying were then carried out to complete the cleaning step.

The cleaned titanium alloy was etched, and the etching steps included: immersing a cleaned titanium alloy in an etching solution, using the titanium alloy being an anode, and applying a voltage to form first holes 22 on the titanium alloy to form a titanium alloy product 100.

The formed titanium alloy product 100 was tested for hole depth, diameter, hole-forming rate, and tensile strength of bonding. The steps of the tensile test included forming a material part 210 (PA glue) in the first holes 22 of the titanium alloy product 100, and testing the tensile strength required to separate the titanium alloy substrate 10 and the material part 210 to detect the tensile strength of bonding of the titanium alloy substrate 10 and the material part 210.

Example 1-1

Mass fractions of ethylene glycol (organic liquid), sodium chloride (chloride), deionized water (cosolvent) and oxalic acid (additive) in the etching solution were 85%, 3%, 10%, and 2% respectively. The voltage was applied to generate the current density in the etching solution of 10 A/dm$^2$, an etching temperature was 60 degrees Celsius, and an etching time was 40 min.

Example 1-2

A difference between the Example 1-1 and the Example 1-2 was that the organic liquid in the etching solution of the Example 1-2 was diethylene glycol.

Example 1-3

A difference between the Example 1-1 and the Example 1-3 was that the organic liquid in the etching solution of the Example 1-3 was propylene glycol.

Example 1-4

A difference between the Example 1-1 and the Example 1-4 was that the organic liquid in the etching solution of the Example 1-4 was glycerol.

Example 1-5

A difference between the Example 1-1 and the Example 1-5 was that the organic liquid in the etching solution of the Example 1-5 was lactic acid.

Example 1-6

A difference between the Example 1-1 and the Example 1-6 was that the organic liquid in the etching solution of the Example 1-6 was triethanolamine.

Comparative Example 1-1

A difference between the Example 1-1 and the Comparative example 1-1 was that the mass fractions of deionized water, sodium chloride and oxalic acid in the etching solution of the Comparative example 1-1 were 95%, 3%, and 2% respectively. That is, the etching solution of Comparative Example 1 did not contain an organic liquid.

Referring to Table 1 for the main different conditions and test results of Examples (short to Ex) 1-1 to 1-6 and Comparative Examples (short to Co-ex) 1-1.

TABLE 1

| | | results | | | |
|---|---|---|---|---|---|
| Ex/Co-ex | different conditions organic liquid | diameter (μm) | depth (hole-m) | hole-forming rate | tensile strength (MPa) |
| Ex 1-1 | ethylene glycol | 300-600 | 15-25 | 25% | 15-30 |
| Ex 1-2 | diethylene glycol | 200-300 | 15-30 | 30% | 20-35 |
| Ex 1-3 | propylene glycol | 100-200 | 20-80 | 55% | 25-55 |
| Ex 1-4 | glycerol | 100-150 | 30-120 | 60% | 30-60 |
| Ex 1-5 | lactic acid | 5-30 | 10-20 | 52% | 30-60 |
| Ex 1-6 | triethanolamine | 300-700 | 40-150 | 15% | 15-25 |
| Co-ex 1-1 | none | Unable to form a hole | Unable to form a hole | 0% | none |

It can be seen from the data in Table 1: Comparing Comparative Example 1-1 with Examples 1-1 to 1-6, the etching solutions of Comparative Example 1-1 do not contain organic liquid, and Examples 1-1 to 1-6 all contain organic liquids, thus Comparative Example 1-1 reveals that the first holes 22 on the titanium alloy were not formed under the same etching conditions as those of Examples 1-1 to 1-6. The results show that organic liquids can provide a stable environment for the etching of the titanium alloy. In Examples 1-1 to 1-6, the etching solutions containing different kinds of organic liquids, the first holes 22 formed have certain differences in the diameter, depth, and hole-forming rate.

Example 2-1

Mass fractions of glycerol (organic liquid), sodium chloride (chloride), deionized water (cosolvent) and oxalic acid (additive) in the etching solution were 85%, 4%, 10%, and 1% respectively. The voltage was applied to generate the current density in the etching solution of 5 A/dm$^2$, an etching temperature was 80 degrees Celsius, and an etching time was 20 min.

Example 2-2

A difference between the Example 2-1 and the Example 2-2 was that the mass fraction of glycerol in the etching solution of the Example 2-2 is 75%, and the mass fraction of deionized water of the Example 2-2 is 20%.

Example 2-3

A difference between the Example 2-1 and the Example 2-3 was that the mass fraction of glycerol in the etching solution of the Example 2-3 is 65%, and the mass fraction of deionized water of the Example 2-3 was 30%.

Comparative Example 2-1

A difference between the Example 2-1 and the Comparative Example 2-1 was that the mass fraction of glycerol in the etching solution of the Comparative Example 2-1 was 55%, and the mass fraction of deionized water of the Comparative Example 2-1 was 40%.

Comparative Example 2-2

A difference between the Example 2-1 and the Comparative Example 2-2 was that the mass fraction of glycerol in the etching solution was 95% and did not contain a cosolvent.

Referring to Table 2 for the main different conditions and test results of Examples (short to Ex) 2-1 to 2-3 and Comparative Examples (short to Co-ex) 2-1 to 2-2.

TABLE 2

| | different conditions | | results | | | |
|---|---|---|---|---|---|---|
| Ex/ Co-ex | mass fraction of organic liquid | mass fraction of cosolvent | diameter (μm) | depth(μm) | hole-forming rate | tensile strength (MPa) |
| Ex 2-1 | 85% | 10% | 100-200 | 20-80 | 55% | 30-60 |
| Ex 2-2 | 75% | 20% | 200-300 | 15-50 | 35% | 15-30 |
| Ex 2-3 | 65% | 30% | 300-400 | 5-10 | 20% | 5-15 |
| Co-ex 2-1 | 55% | 40% | unable to form a hole | unable to form a hole | 0% | none |
| Co-ex 2-2 | 95% | / | no significant changes | no significant changes | / | / |

It can be seen from the data in Table 2: Comparing Examples 2-1 to 2-3 with Comparative Examples 2-1 to 2-2, the mass fraction of the organic liquid and the cosolvent has a great influence on the formation of the first holes 22. The larger the mass fraction of the organic liquid and the smaller the mass fraction of the cosolvent, the smaller the diameter of the first holes 22, the greater the depth of the first holes 22, and the greater the hole-forming rate of the first holes 22, so that the greater the tensile strength between the titanium alloy substrate 10 and the material part 210. The cosolvent is conducive to the dissolution of chloride used for corrosion. When the mass fraction of the cosolvent is too large (for example, Co-ex 2-1), it will cause a surfacing corrosion on the titanium alloy and first holes 22 with a reasonable size will not be formed. When there is no cosolvent, the chloride cannot dissociate a large amount of $Cl^-$ for corrosion of the titanium alloy, there is no obvious change and no holes can be formed on the titanium alloy. In Comparative Example 2, the etching solution contains a large amount of organic solvents but does not contain cosolvent. In the organic system, the movement speed of the ions is too slow, which leads to the reduction of the corrosiveness of the etching solution, and it cannot form holes defined in the titanium alloy, that is, there is no obvious change on the titanium alloy.

Example 3-1

An etching solution included diethylene glycol (organic liquid), sodium chloride (chloride), deionized water (cosolvent), and oxalic acid (additive). Mass fractions of diethylene glycol (organic liquid), sodium chloride (chloride) in the etching solution were 80%, 10% respectively. A molar ratio of sodium chloride to oxalic acid was 3:1. The voltage was applied to generate the current density in the etching solution of 12 A/dm$^2$, an etching temperature was 50 degrees Celsius, and an etching time was 10 min.

Example 3-2

A difference between the Example 3-1 and the Example 3-2 was that the molar ratio of sodium chloride to oxalic acid of the Example 3-2 was 2:1.

Example 3-3

A difference between the Example 3-1 and the Example 3-3 was that the molar ratio of sodium chloride to oxalic acid of the Example 3-3 was 1:1.

Comparative Example 3-1

A difference between the Example 3-1 and the Comparative Example 3-1 was that the molar ratio of sodium chloride to oxalic acid of the Comparative Example 3-1 was 1:2.

Referring to Table 3 for the main different conditions and test results of Examples (short to Ex) 3-1 to 3-3 and Comparative Example (short to Co-ex) 3-1.

TABLE 3

| | | results | | | |
|---|---|---|---|---|---|
| Ex/Co-ex | different conditions molar ratio | diameter (μm) | depth (μm) | hole-forming rate | tensile strength (MPa) |
| Ex 3-1 | 3:1 | 150-200 | 5-15 | 40% | 25-35 |
| Ex 3-2 | 2:1 | 150-300 | 15-30 | 30% | 20-30 |
| Ex 3-3 | 1:1 | 200-300 | 5-10 | 10% | 10-15 |
| Co-ex 1-1 | 1:2 | Unable to form a hole | Unable to form a hole | 0% | none |

It can be seen from the data in Table 3: A proper molar ratio of chloride to additive adjusts the diameter, depth, and hole-forming rate of the first holes 22 formed, so as to improve the tensile strength between the titanium alloy substrate 10 and the material part 210. When the molar ratio of the chloride to the additive is too small, that is, the content of the chloride is too small, which leads to a decrease in the corrosion ability of $Cl^-$ and reduces the number of effective first holes 22. The molar ratio of the chloride to the additive is too large, that is, too much chloride content causing surface corrosion. Oxalic acid can control the acidity of the etching solution, and at the same time can complex free titanium ion to stabilize the etching solution and promote the process of the etching reaction.

Example 4-1

Mass fractions of lactic acid (organic liquid), deionized water (cosolvent), and ferric chloride (chloride) in the etching solution were 85%, 10%, and 5% respectively. The voltage was applied to generate the current density in the etching solution of 15 A/dm$^2$ an etching temperature was 40 degrees Celsius, and an etching time was 30 min.

Example 4-2

A difference between the Example 4-1 and the Example 4-2 was that citric acid (acid additive) of the Example 4-2 was also added to the etching solution, the mass fraction of citric acid in the etching solution was 1%, and the mass fraction of deionized water in the etching solution was 10%.

Example 4-3

A difference between the Example 4-1 and the Example 4-3 was that citric acid (acid additive) of the Example 4-3 was also added to the etching solution, the mass fraction of citric acid in the etching solution was 2%, and the mass fraction of deionized water in the etching solution was 10%.

Referring to Table 4 for the main different conditions and test results of Examples (short to Ex) 4-1 to 4-3.

TABLE 4

| | different conditions | | results | | | |
|---|---|---|---|---|---|---|
| Ex/Co-ex | mass fraction of cosolvent | mass fraction of acid additive | diameter (μm) | depth(μm) | hole-forming rate | tensile strength (MPa) |
| Ex 4-1 | 10% | / | 10-20 | 5-10 | 50% | 20-30 |
| Ex 4-2 | 10% | 1% | 15-30 | 15-50 | 45% | 30-50 |
| Ex 4-3 | 10% | 2% | 20-40 | 10-30 | 25% | 25-45 |

It can be seen from the data in Table 4: Adding a certain amount of acidic additive to the etching solution increases the depth of the first holes 22, thereby increasing the tensile strength between the titanium alloy substrate 10 and the material part 210. However, too much acidic additive will cause the diameter of the first holes 22 in some areas to be too large, and the hole-forming rate is also decrease, resulting in a decrease in the tensile strength.

Figure 14:
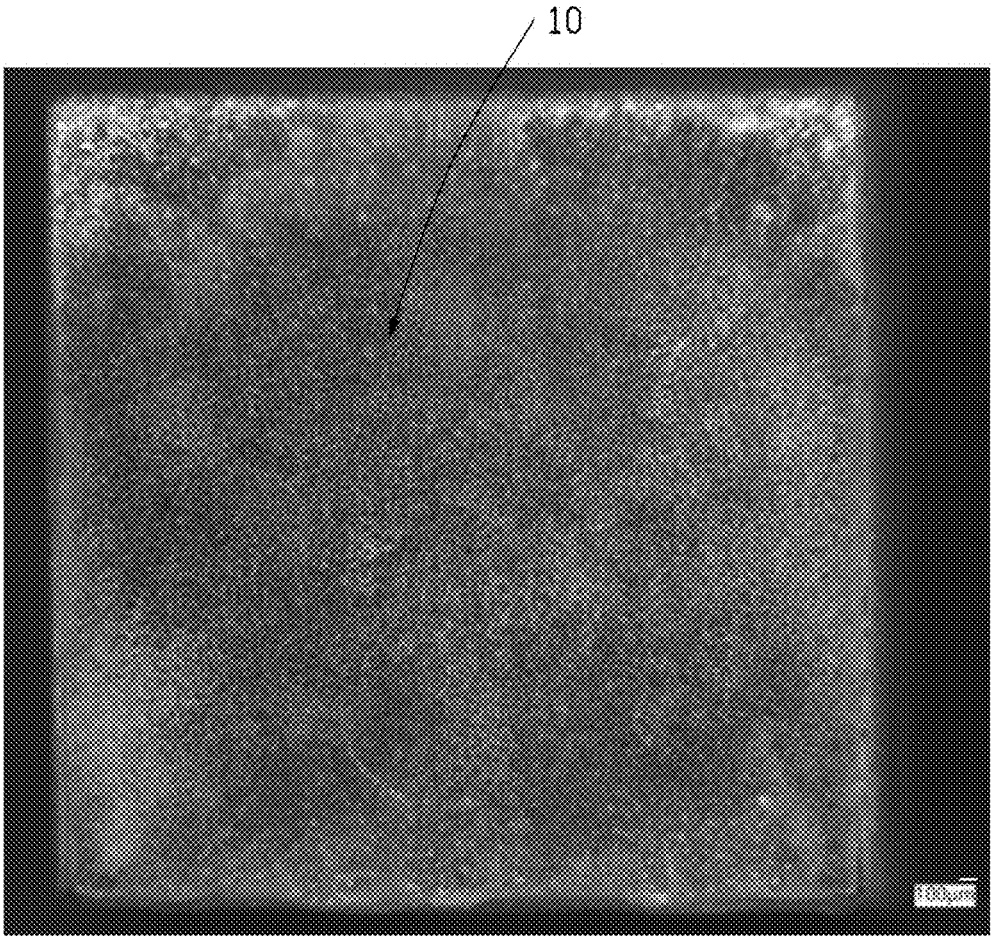
FIG. 14 is a micrograph of the first holes formed on the titanium alloy substrate in Example 4-3, taken by a Keyence laser microscope.
Figure 15:
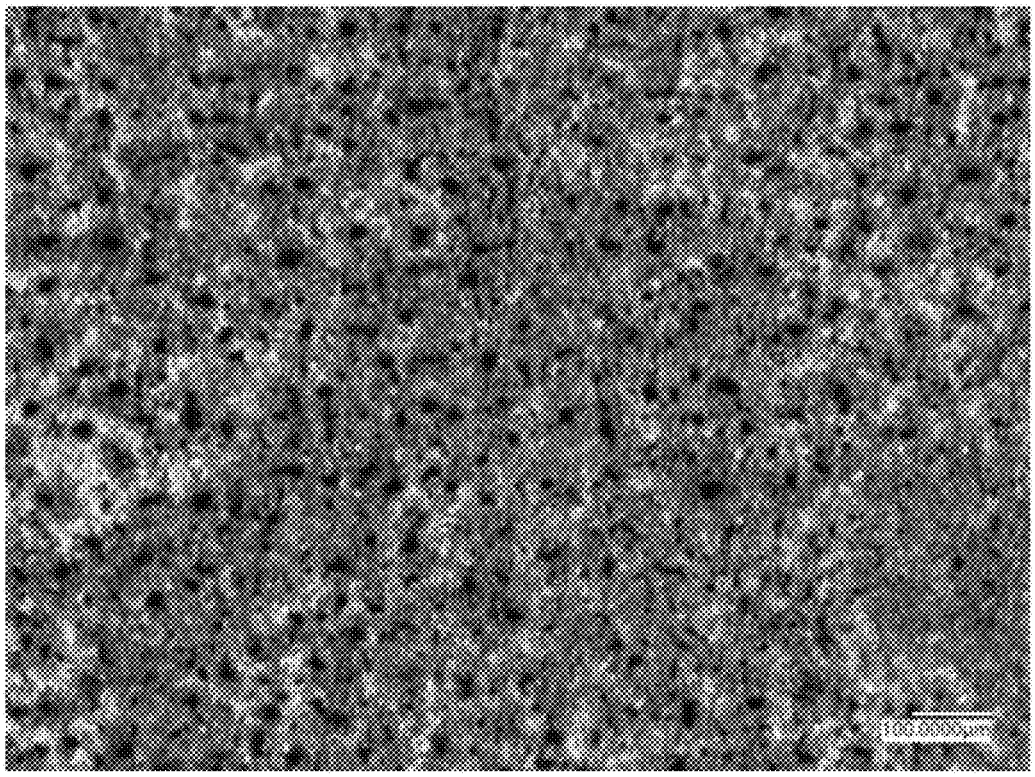
FIG. 15 is an enlarged sectional micrograph of FIG. 14.
Figure 16:
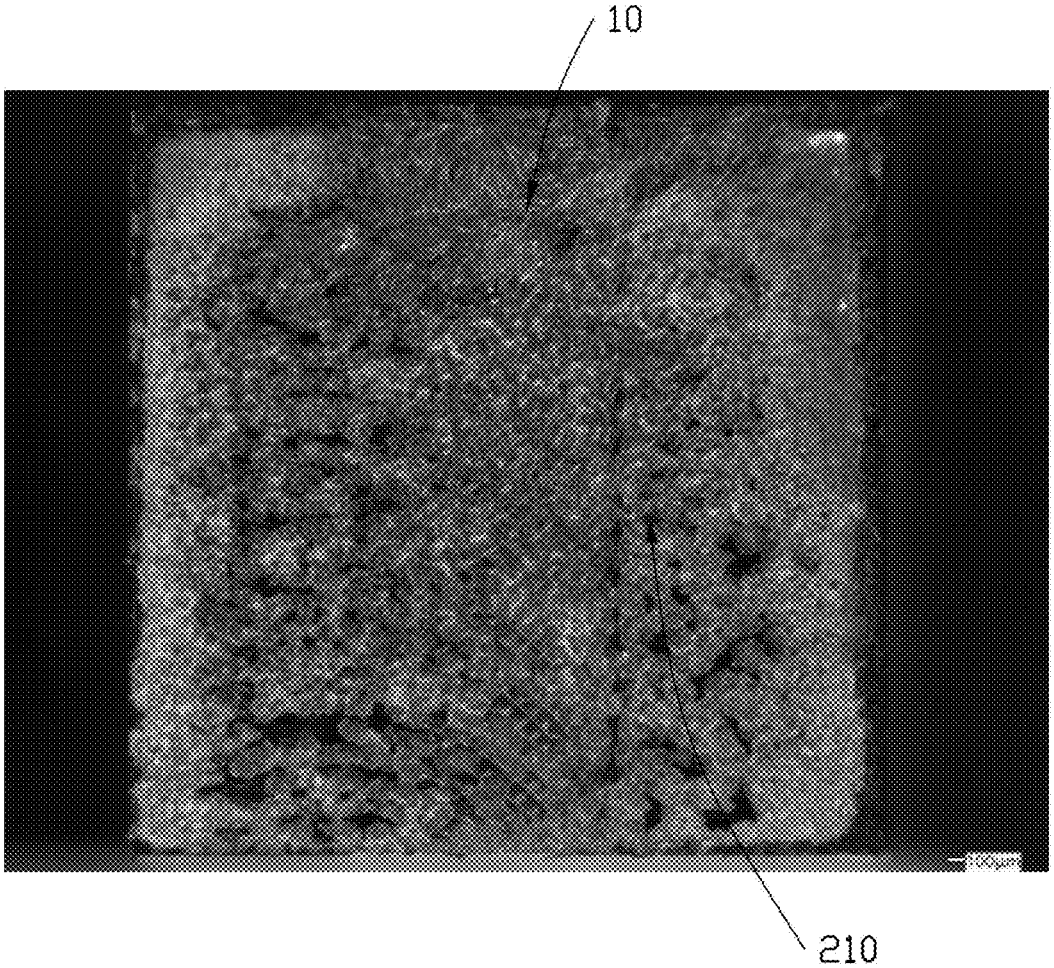
FIG. 16 is a micrograph wherein a part of the material part separated from the titanium alloy substrate of FIG. 14, leaving other part of the material part in the holes, which is taken by a Keyence laser microscope.

Referring to FIGS. 14 and 15, which are micrographs of the first holes 22 formed on the titanium alloy in Example 4-3 of the present disclosure taken by a Keyence laser microscope. FIG. 14 is magnified 30 times, and FIG. 15 is magnified 200 times. Referring to FIG. 16, a micrograph taken after the titanium alloy substrate 10 and the material part 210 are separated after the material part 210 formed in the first holes 22 of the titanium alloy shown in FIG. 14, and material part 210 is left in the first holes 22.

Example 5-1

Mass fractions of triethanolamine (organic liquid), deionized water (cosolvent) and sodium chloride (chloride) in the etching solution were 75%, 20%, and 5% respectively. The voltage was applied to generate the current density in the etching solution of 15 A/dm$^2$, an etching temperature was 45 degrees Celsius, and an etching time was 30 min.

Example 5-2

A difference between the Example 5-1 and the Example 5-2 was that sodium hydroxide (alkaline additive) of the Example 5-2 was also added to the etching solution, the mass fraction of sodium hydroxide in the etching solution was 4%, and the mass fraction of deionized water in the etching solution was 20%.

Example 5-3

A difference between the Example 5-1 and the Example 5-3 was that sodium hydroxide (alkaline additive) of the Example 5-3 was also added to the etching solution, the mass fraction of sodium hydroxide in the etching solution was 8%, and the mass fraction of deionized water in the etching solution was 20%.

Referring to Table 5 for the main different conditions and test results of Examples (short to Ex) 5-1 to 5-3.

TABLE 5

| | different conditions | | results | | | |
|---|---|---|---|---|---|---|
| Ex/ Co-ex | mass fraction of cosolvent | mass fraction of alkaline additive | diameter (μm) | depth (μm) | hole-forming rate | tensile strength (MPa) |
| Ex 5-1 | 20% | / | 300-400 | 20-40 | 15% | 10-15 |
| Ex 5-2 | 20% | 4% | 400-500 | 60-120 | 10% | 15-25 |
| Ex 5-3 | 200/a | 8% | 500-800 | 70-150 | 5% | 5-10 |

It can be seen from the data in Table 5: Adding a certain amount of alkaline additive to the etching solution increases the depth of the first holes 22, thereby increasing the tensile strength between the titanium alloy substrate 10 and the material part 210. However, too much alkaline additive will cause the diameter of the first holes 22 in some areas too large, and the hole-forming rate is also decrease, resulting in a decrease in the tensile strength.

Figure 17:
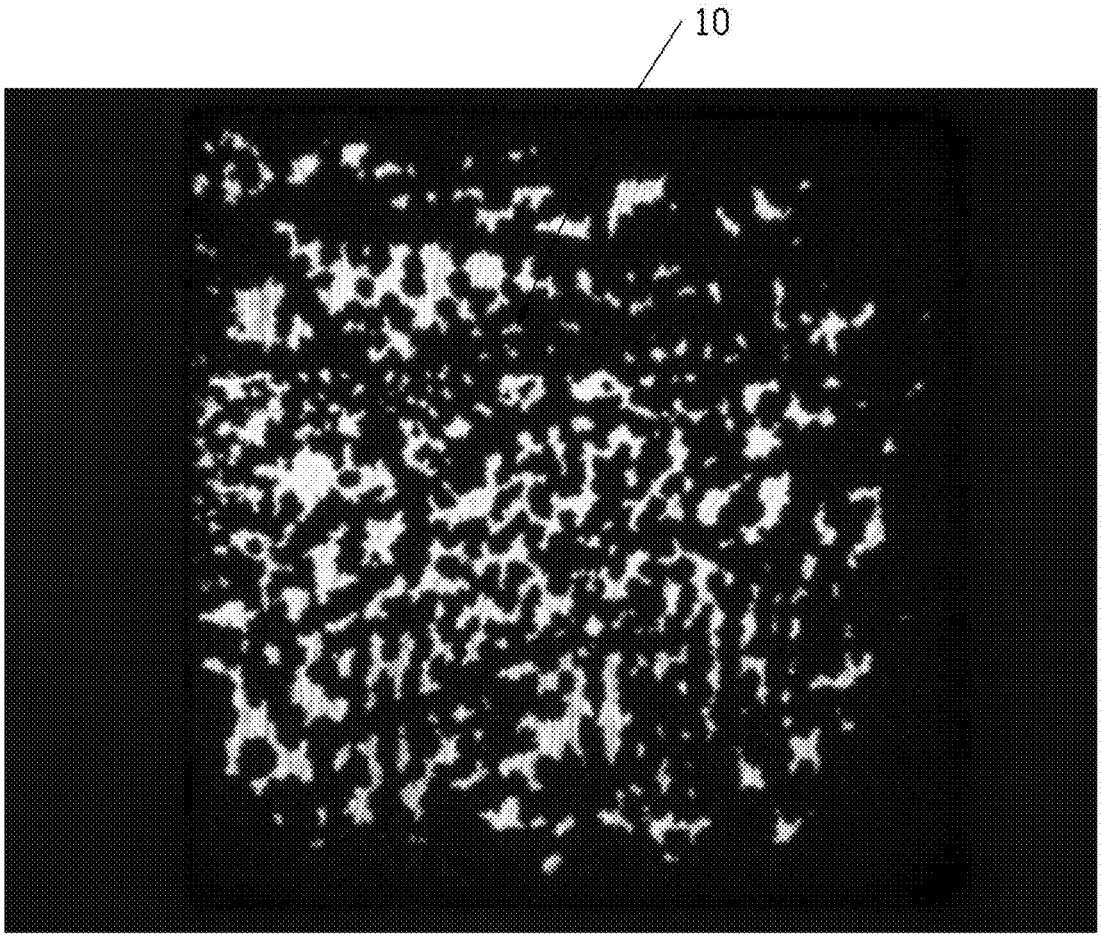
FIG. 17 is a micrograph of the first holes formed on the titanium alloy substrate in Example 5-2, taken by a Keyence laser microscope.
Figure 18:
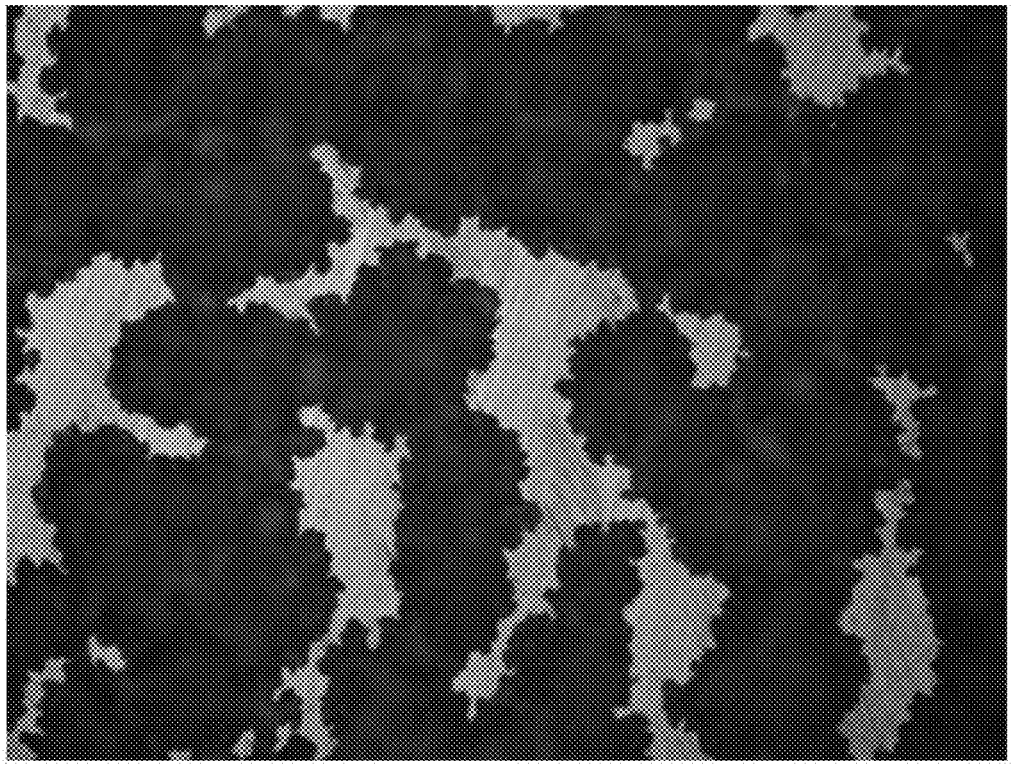
FIG. 18 is an enlarged sectional micrograph of FIG. 17.
Figure 19:
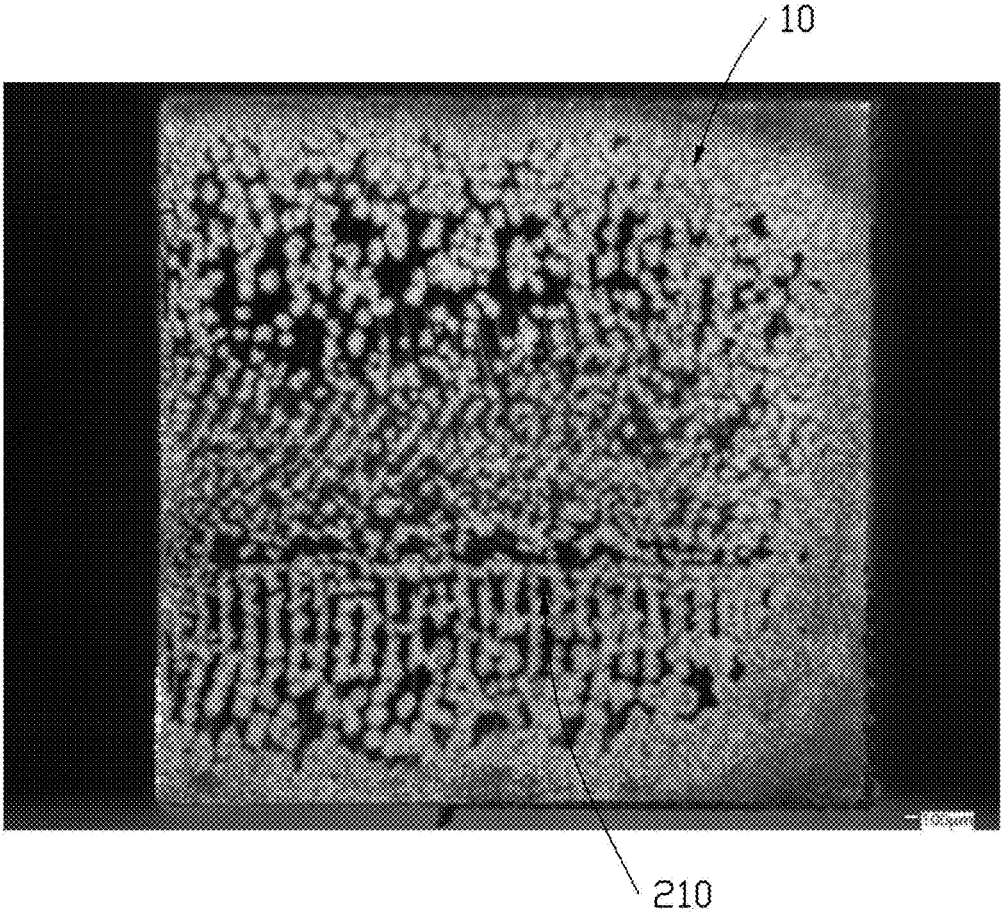
FIG. 19 is a part of the material part separated from the titanium alloy substrate of FIG. 17, leaving other part of the material part in the holes, taken by a Keyence laser microscope.

Referring to FIGS. 17 and 18, which are micrographs of the first holes 22 formed on the titanium alloy in Example 5-2 of the present disclosure taken using a Keyence laser microscope. FIG. 17 is a micrograph magnified 30 times, and FIG. 18 is a micrograph magnified 200 times. Referring to FIG. 19, which is a micrograph after the titanium alloy substrate 10 and the material part 210 are separated after the material part 210 is formed in the first holes 22 of the titanium alloy shown in FIG. 17, and material part 210 is left in the first holes 22.

The present disclosure provides the titanium alloy product 100. The surface of the titanium alloy product 100 has first holes 22 with openings, which can increase the tensile strength of the titanium alloy product 100 and the material part 210 filled in the first holes 22, thereby increasing the bonding strength of the titanium alloy product 100 and the material part 210.

It is to be understood, even though information and advantages of the present embodiments have been set forth in the foregoing description, together with details of the structures and functions of the present embodiments, the disclosure is illustrative only; changes may be made in detail, especially in matters of shape, size, and arrangement of parts within the principles of the present embodiments to the full extent indicated by the plain meaning of the terms in which the appended claims are expressed.

What is claimed is:

1. A method of manufacturing a titanium alloy product, comprising:

a titanium alloy workpiece comprising a titanium alloy part and an aluminum alloy part, immersing the titanium alloy workpiece in an electrolyte, applying a voltage on the titanium alloy workpiece as an anode to form an anodized film on the aluminum alloy part;

applying a sandblasting treatment on a titanium alloy workpiece;

immersing the titanium alloy workpiece applied the sandblasting treatment into an etching solution, applying a voltage on the titanium alloy workpiece being an anode to form a plurality of first holes in a titanium alloy part of the titanium alloy workpiece, thereby obtaining the titanium alloy product;

wherein the etching solution comprises an organic liquid, a cosolvent, and a chloride; the chloride dissociates $Cl^-$ in the cosolvent, and the organic liquid and the cosolvent dissolve each other.

2. The method of claim 1, wherein the titanium alloy part comprises aluminum element; the etching solution further comprises an alkaline additive or an acidic additive; the alkaline additive or the acidic additive reacts with the aluminum elements, $Cl^-$ in the chloride reacts with the titanium elements in the titanium alloy part to form the plurality of first holes and a plurality of second holes defined in the titanium alloy part; the plurality of second holes are radially disposed on an inner wall of the first holes, and the inner wall of the plurality of first holes is further recessed to form the plurality of second holes.

3. The method of claim 1, wherein the voltage applied on the titanium alloy workpiece to generate a current density in the etching solution, the current density is in a range of 2 $A/dm^2$ to 15 $A/dm^2$.

4. The method of claim 1, wherein the electrolyte is at least one selected from a group consisting of phosphoric acid, sulfuric acid, and oxalic acid; the voltage applied on the titanium alloy workpiece is in a range of 10 V to 30 V.

5. The method of claim 4, wherein after immersing the titanium alloy workpiece into the etching solution, the method further comprises:

immersing the titanium alloy workpiece into a corrosive solution to form a plurality of third holes defined in the aluminum alloy part; the corrosive solution comprises water, chloride, and inorganic acid; a concentration of the chloride in the corrosive solution is in a range of 10 g/L to 50 g/L, a concentration of the inorganic acid in the corrosive solution is in a range of 10 g/L to 100 g/L.

6. The method of claim 1, wherein a ratio of the organic liquid to the cosolvent by volume is in a range of 2:1 to 10:1.

7. The method of claim 1, wherein a relative dielectric constant of the organic liquid is in a range of 20 to 50.

8. The method of claim 1, wherein a conductivity of the etching solution is in a range of 0.3 μS/cm to 30 μS/cm.

9. The method of claim 1, wherein the etching solution further comprises an alkaline additive or an acidic additive; the alkaline additive is at least one selected from a group consisting of an inorganic base and an organic base; the inorganic base is at least one selected from a group consisting of sodium hydroxide and potassium hydroxide.

10. The method of claim 9, wherein the organic acid comprises an oxalic acid; a molar ratio of $Cl^-$ dissociated from the chloride in the cosolvent to the oxalic acid is in a range of 1:1 to 5:1.

* * * * *